US010395637B2

(12) United States Patent
Goto et al.

(10) Patent No.: US 10,395,637 B2
(45) Date of Patent: Aug. 27, 2019

(54) DEVICE FOR REDUCING NOISE, FLIGHT VEHICLE, AND PROGRAM

(71) Applicant: KABUSHIKI KAISHA TOSHIBA, Tokyo (JP)

(72) Inventors: Tatsuhiko Goto, Kanagawa (JP); Akihiko Enamito, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 71 days.

(21) Appl. No.: 15/693,462

(22) Filed: Aug. 31, 2017

(65) Prior Publication Data

US 2018/0204561 A1 Jul. 19, 2018

(30) Foreign Application Priority Data

Jan. 13, 2017 (JP) ..... 2017-004535

(51) Int. Cl.
*G10K 11/178* (2006.01)

(52) U.S. Cl.
CPC ..... *G10K 11/1786* (2013.01); *G10K 11/178* (2013.01); *G10K 11/17857* (2018.01);
(Continued)

(58) Field of Classification Search
CPC ..... G10K 11/178; G10K 11/16; G10K 2210/3028; G10K 2210/1281;
(Continued)

(56) References Cited

U.S. PATENT DOCUMENTS 5,515,444 A 5/1996 Burdisso et al.
7,272,234 B2 9/2007 Sommerfeldt et al.
(Continued)

FOREIGN PATENT DOCUMENTS

JP H01-159406 6/1989
JP H01-12800 8/1989
(Continued)

OTHER PUBLICATIONS

Y. Honda et al., "Active Minimization of Blade Rotational Noise From an Axial Fan", Transactions of the Japan Society of Mechanical Engineers (Part C), vol. 59, No. 562, 92-1472, pp. 228-233, 1993.
(Continued)

*Primary Examiner* — Paul Kim
*Assistant Examiner* — Ubachukwu A Odunukwe
(74) *Attorney, Agent, or Firm* — Finnegan, Henderson, Farabow, Garrett & Dunner, L.L.P.

(57) ABSTRACT

According to one embodiment, a rotating blade noise reduction device for reducing noise from a flight vehicle including rotating blades, the device includes loudspeakers, one or more reference microphones, an estimator, and a processor. The loudspeakers are arranged coaxially in a circumferential form for each of the rotating blades. The reference microphones acquire noise generated from the rotating blades and control sounds generated from the loudspeakers. The estimator estimates angular frequencies of the rotating blades. The processor generates control signals so as to reduce sound pressures at the reference microphones, delays the control signals by time delays corresponding to the loudspeakers dependent on installation angles between the loudspeakers arranged coaxially in a circumferential form from a circle center, the angular frequencies estimated, and a number of the loudspeakers, and inputs the control signals to the loudspeakers.

15 Claims, 26 Drawing Sheets

(52) U.S. Cl.
CPC ..... *G10K 11/17883* (2018.01); *G10K 2210/1281* (2013.01); *G10K 2210/3044* (2013.01); *G10K 2210/3046* (2013.01)

(58) Field of Classification Search
CPC ..... G10K 11/1786; G10K 11/17857; G10K 11/17883; G10K 2210/3044; G10K 11/175; G10L 21/028
USPC ..... 381/71.4, 71.6
See application file for complete search history.

(56) References Cited

U.S. PATENT DOCUMENTS

| | | | | |
|---|---|---|---|---|
| 2003/0219132 | A1* | 11/2003 | Sommerfeldt | G10K 11/178 381/71.14 |
| 2009/0074199 | A1* | 3/2009 | Kierstein | G10K 11/175 381/71.6 |
| 2014/0079234 | A1* | 3/2014 | Butts | G10L 21/0208 381/71.6 |
| 2017/0243574 | A1* | 8/2017 | Wu | G10K 11/178 |

FOREIGN PATENT DOCUMENTS

| | | |
|---|---|---|
| JP | H01-128000 | 8/1989 |
| JP | H11-502032 | 2/1999 |
| JP | 2003-233133 | 8/2003 |
| JP | 2006-003756 | 1/2006 |
| JP | 2006-211770 | 8/2006 |
| JP | 2012-088734 | 5/2012 |

OTHER PUBLICATIONS

T. Aoki et al., "Active Control of Fan Noise in Free Space Based on Spherical Harmonic Expansion", Journal of the Acoustical Society of Japan, vol. 59, No. 7, pp. 379-387, 2003.
Y. Honda et al., "Active Minimization of Blade Rotational Noise From an Axial Fan", Transactions of the Japan Society of Mechanical Engineers (Part C), vol. 59, No. 92-1472, pp. 228-233, 1993.
T. Aoki et al., "Active Control of Fan Noise in Free Space Based on Spherical Harmonic Expansion", Journal of the Acoustical Society of Japan, vol. 59, No. 7, pp. 379-389, 2003.
T. Aoki et al., "Theoretical Study on Active Control of Rotational Noise Source Using Discrete Ring Sound Source", Japan Acoustical Society Journal, vol. 60, No. 11, pp. 639-645, 2004.

* cited by examiner

DEVICE FOR REDUCING NOISE, FLIGHT VEHICLE, AND PROGRAM

CROSS-REFERENCE TO RELATED APPLICATIONS

This application is based upon and claims the benefit of priority from Japanese Patent Application No. 2017-004535, filed Jan. 13, 2017, the entire contents of all of which are incorporated herein by reference.

FIELD

Embodiments described herein relate generally to a device for reducing noise, a flight vehicle, and a program.

BACKGROUND

In recent years, a multirotor flight vehicle, which includes four or more propellers, each having two or three blades, and flies by rotating them, has begun to be frequently used for the purpose of transportation and photographing. The multirotor flight vehicle flies by rotating these propellers, and hence generates airfoil flow noise. In addition, as the sizes of flight vehicles increase, noise increasingly raises problems.

As a method of reducing noise, ANC (active noise control) is known, ANC outputs a signal (control sound) having the same amplitude and an opposite phase as compared with noise from a control loudspeaker in order to reduce noise.

Honda, Y., Saburi, S., Matsuhisa, H, and Sato, S., Active Minimization of Blade Rotational Noise from an Axial Fan, The Japan Society of Mechanical Engineers, (C)59(562), 228-233 (1933), which presents theoretical analysis on an active noise reduction technique for axial fan noise, discloses a rotating blade rotation model of an axial fan as a multiple sound source and a method of reducing fan noise by arranging control loudspeakers coaxially in a circumferential form with respect to a rotating blade rotation center so as to minimize acoustic power. In addition, according to Aoki, T., Morishita, T., Tanaka, T. and Taki, M., Active control of fan noise in a free field based on the spherical harmonic expansion, Acoustical Society of Japan, 59(2003) 379-387 and Aoki, T., Tanaka, T. and Taki, M., Active control of circular noise source using discrete ring sources: A theoretical consideration, Acoustical Society of Japan, 60(2004) 639-645, a rotating blade rotation model is expanded based on spherical surface harmonics, and mode amplitudes from a main source originating from rotating blade rotation and a control sound source originating from control loudspeakers arranged on a circumference are matched with each other to implement active noise reduction. According to the three literatures described above, the count of control loudspeakers arranged on a circumference has been derived to be 2M+1 as a minimum count and 2M+3 (even using 2M+3 or more control loudspeakers will not reduce the effect) as a maximum count.

DETAILED DESCRIPTION

Figure 1:
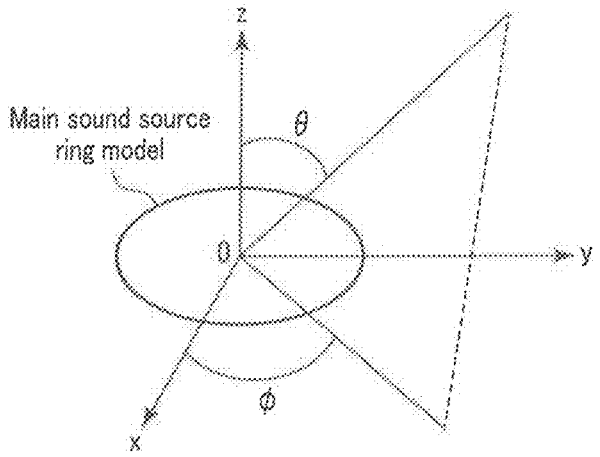
FIG. 1 is a view showing a main sound source ring model and a three-dimensional polar coordinate system according to embodiments.

Embodiments will be described below with reference to the accompanying drawings. In the following embodiments, the like reference numerals denote the like elements, and a repetitive description will be omitted. These embodiments each will exemplify a device for reducing the rotating blade noise generated by a flight vehicle, a flight vehicle, and a program.

Each of the above three literatures is based on the premise that studies have been conducted by theoretical analysis, and the angle of a main sound source at which a reference phase is generated and the magnitude of a volume velocity virtually arranged on a circumference are known. In general, however, these pieces of information need to be measured separately and cannot be obtained at the same time with active noise reduction.

As described above, a practical noise reduction technique for an active noise reduction system has not been clarified. In addition, because the respective rotors of a flight vehicle generate similar angular frequencies during hovering flight, noise interference makes it impossible for usual ANC techniques to achieve active noise reduction.

These embodiments, therefore, each aim at providing a rotating blade noise reduction device which reduces the noise generated by a plurality of rotating blades, a flight vehicle, and a program.

According to one embodiment, a rotating blade noise reduction device for reducing noise from a flight vehicle including rotating blades, the device includes loudspeakers, one or more reference microphones, an angular frequency estimator, and an active noise reduction processor. The loudspeakers are arranged coaxially in a circumferential form for each of the rotating blades. The one or more reference microphones acquire noise generated from the rotating blades and control sounds generated from the loudspeakers. The angular frequency estimator estimates angular frequencies of the rotating blades. The active noise reduction processor generates control signals so as to reduce sound pressures at the reference microphones, delays the control signals by time delays corresponding to the loudspeakers dependent on installation angles between the loudspeakers arranged coaxially in a circumferential form from a circle center, the angular frequencies estimated, and a number of loudspeakers, and inputs the control signals to the loudspeakers.

A rotating blade noise reduction device, a flight vehicle, and a program according to each, embodiment will be briefly described first.

Each embodiment will explain a technique for reducing the airfoil flow noise generated by each rotor. The ANC (Active Noise Control) arrangement of the rotating blade noise reduction device according to the embodiment is configured to reduce sound pressures at a reference point by using, for example, a plurality of control loudspeakers arranged in a ring form and one reference microphone. It is possible to adjust the phases of sounds from the plurality of control loudspeakers depending on blade angular frequencies. In addition, according to the embodiment, the optimal installation position of the reference microphone is determined by expressing sound pressures at this reference point by a spherical harmonic expansion.

In addition, during, for example, the hovering flight of the flight vehicle, the angular frequencies of the respective rotors are similar to each other, and noise from all the rotors is mixed in the reference microphone attached to each rotor. The rotating blade noise reduction device according to each embodiment achieves active noise reduction independently for each rotor by providing decoupling between the respective rotors. The embodiment also provides the installation positions (microphone positions) of noise cancellation points in active noise reduction and a rotating blade noise reduction device for reducing rotating blade noise as periodic noise.

Furthermore, because the respective rotors generate similar angular frequencies during the hovering flight of the flight vehicle, noise interference makes it impossible for usual ANC techniques to achieve active noise reduction. In contrast to this, the rotating blade noise reduction device according to each embodiment presents two solution methods. The first method is a MIMO type active noise reduction method, which performs active noise reduction in consideration of the influence of crosstalk between the respective rotors (third embodiment). The second method is to perform airfoil flow noise reduction independently for each rotor by forming a ring array microphone which acquires only noise around each rotor by delaying each reference microphone signal obtained from each of a plurality of reference microphones arranged on each rotor circumference in accordance with a fan angular frequency and the reference microphone count (fourth embodiment).

The main points of these embodiments are to present an optimal reference microphone installation place (first embodiment), to provide a rotating blade noise reduction, device for reducing axial flow noise (second embodiment), and to provide a technique for decoupling between rotors (third and fourth embodiments).

Before the description of the first embodiment, techniques common to all the embodiments will be described below with reference to FIGS. 1, 2, 3, 4A, 4B, 5, 6, 7, 8, and 9.

(Rotating Blade Noise Rotational Noise Model)

A rotating blade rotation model of an axial fan as a multiple sound source will be described first with reference to FIG. 1.

In a rotating blade rotation model, the time (t) dependence of a sound pressure and the angle (φ) dependence of a rotation direction are represented by the following equations:

$$P(\phi, t) = \mathrm{Re}\left\{\sum_{x=1}^{inf} a_x e^{iBx(\Omega t-\phi)}\right\} \tag{1}$$

$$P(\phi, t) = \mathrm{Re}\left\{\sum_{x=1}^{inf} \eta a_x e^{iBx(\Omega t-\phi-\beta)}\right\} \tag{2}$$

This multiple sound source has a noise characteristic different from general noise radiation characteristics, with the phases rotating together with the rotating blades. Assume that B represents a rotating blade count (i.e., the number of the rotating blades), x represents a harmonic order, Ω represents a blade angular frequency, $i^2=-1$, and inf represents infinity (∞). The angular frequency of generated fan noise is represented by ΩBx, and ΩB with, x=1 is called a blade pass frequency. For the sake of simplicity, M=Bx. In addition, $a_x$ represents the complex amplitude of an x-order harmonic. Note that η and β are appropriate constants. In the following description, the three-dimensional polar coordinate system shown in FIG. 1 is used as a coordinate system. Note that because neglecting sound pressures originating from the bipolar sound source represented by equation (2) will have no influence on noise reduction in terms of analysis, equation (1) is used as a rotating blade rotation model in the following embodiments.

(Required Loudspeaker Count)

A required control loudspeaker count and the radii of a main sound source ring and control sound source ring will be described next with reference to the two literatures described above. "Active control of fan noise in a free field based on the spherical harmonic expansion" and "Active control of circular noise source using discrete ring sources: A theoretical consideration". As indicated by the above literature "Active Minimization of Blade Rotational Noise from an Axial Fan", the upper limit of a required control loudspeaker count is 2M+3. Increasing this count will not lead to any improvement in control effect. In addition, according to the two literatures described above: "Active control of fan noise in a free field based on the spherical harmonic expansion" and "Active control of circular noise source using discrete ring sources: A theoretical consideration", the range within which the influence of unnecessary aliasing modes which are not generated in a continuous ring model but are generated in a discrete ring model can be neglected corresponds to 2M+1 as a minimum count. Consequently, from an analytical viewpoint, the required control loudspeaker count is equal to or more than 2M+1 and equal to or less than 2M+3. Note, however, that because setting 2M+2 will greatly reduce aliasing modes and greatly improve the control effect compared with setting 2M+1, the minimum count is preferably set to 2M+2 if a control loudspeaker count is enough. In addition, although the upper limit is theoretically 2M+3, because increasing the control loudspeaker count will further increase the control effect when the difference between the control ring radius and the main sound source ring radius is small, the larger the count, the better. If it is possible to install 2M+3 or more control loudspeakers, it is preferable to increase to the control loudspeaker count.

Table 1 indicates the relationship between an order x with blade count=2 and the minimum count of control loudspeakers to be installed. Assume that active noise reduction is to be executed tip to order x=3 with blade count B=2, the control effect is maximised by referring to Table 1, and 15 control loudspeakers are used. In this case, with order x=1 and 2, loudspeakers to be used exceed the upper limit of a loudspeaker count in terms of control effect. However, because increasing the loudspeaker count will not lead to a deterioration in control effect, 15 control loudspeakers are used even for noise reduction with order x=1 and 2. In the present embodiment, as described above, the loudspeaker count corresponding to the maximum order of a control target is used.

TABLE 1

| | x | | | |
|---|---|---|---|---|
| | 1 | 2 | 3 | 4 |
| Minimum Count | 5 | 9 | 13 | 17 |

In addition, the first embodiment exemplifies different installation positions as the positions of reference microphones in the rotating blade noise reduction device in a case in which the control loudspeaker count is 2M+1 to 2M+2 and a case in which the control loudspeaker count is 2M+3 or more.

(Loudspeaker Ring Radius)

Figure 2:
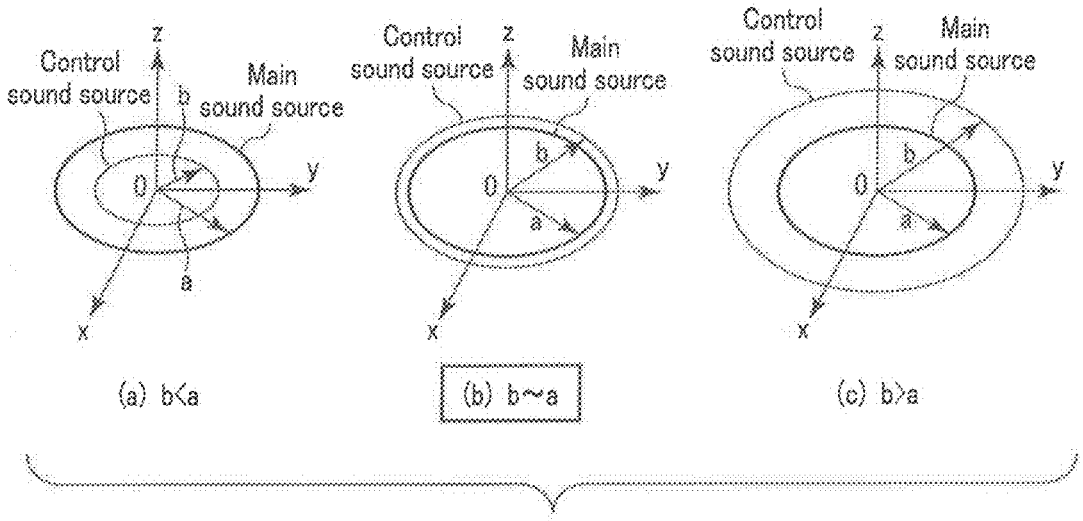
FIG. 2 is a view showing three positional relationships between a main sound source ring model and a control sound source ring according to embodiments.

Three patterns are conceivable as the positional relationships between a main sound source ring and a control sound source ring (also called a control loudspeaker ring), as shown in FIG. 2 (see, for example, the above literature "Active Minimization of Blade Rotational noise from an Axial Fan"). The following description is based on the assumption that the main sound source ring radius is represented by a, and the control sound source ring radius is represented by b.

In the case indicated by (a) of FIG. 2 (b<a), although setting the loudspeaker count to 2M+1 or more provides high controllability and hence is preferable from the viewpoint of control effect, the control loudspeakers are installed within the fan radius. Consequently, because the control loudspeakers block fan airflow, b<a is not preferable in terms of fan performance.

In the case indicated by (b) of FIG. 2 (b≈a), high controllability is provided, and the control loudspeakers can be arranged outside the main sound source. For this reason, (b≈a) is preferable. Here, the "≈" represents "nearly equal to".

In the case indicated by (c) of FIG. 2 (b>a), because the controllability deteriorates, (b>a) is not preferable from the viewpoint of control effect. However, if, for example, the control loudspeakers cannot be arranged near the main sound source, the form indicated by (c) of FIG. 2 needs to be employed. Assume that the Mach number (Ωa)/c (where c represents the acoustic velocity) is equal to or leas than 0.1 (small- to medium-sized flight vehicle propellers generally satisfy this condition), the loudspeaker count is equal to or more than 2M+3, and b≤10a. Under these conditions, a noise reduction effect of 20 dB or more can be expected (for example, FIG. 6 in the above literature "Active Minimization of Blade Rotational noise from an Axial Fan"). In addition, assume that the loudspeaker count is as small as 2M+2 or 2M+1. In the case of 2M+2, a noise reduction effect of 20 dB can be expected under the condition of b<3a, whereas in the case of 2M+1, a noise reduction effect of 10 dB can be expected under the condition of b<2a (for example, FIG. 5 in the above literature "Active Minimization of Blade Rotational noise from an Axial Fan").

In consideration of the above, in each embodiment, the control loudspeaker ring radius b is made as close to the main sound source ring radius a as possible so as to be set to at least 2a or less, dote that because the control sound source ring radius is equal to or less than twice the fan radius, the condition of b<2a or less is not rigorous, and hence can be easily implemented.

Each of the three active noise reduction techniques described above is a theoretical and analytical consideration, and is based on the premise that the reference phase point of the main sound source and the magnitude of a volume velocity virtually arranged on a circumference are known. In general, it is necessary to separately measure these pieces of information, and it is not possible to obtain them at the same time with active noise reduction.

Each embodiment will therefore exemplify that it is possible to achieve active noise reduction for an airfoil fan (a device having rotating blades) by using a rotating blade noise reduction device for reducing sound pressures at a reference point (reference signal) by using one reference microphone or an array microphone which outputs a single output signal. The installation place of a reference microphone, a rotating blade noise reduction device, and its simulation results will be described below.

First Embodiment (Optimal Installation Position of Reference Microphone)

The present embodiment will exemplify the installation position of a reference microphone for evaluating noise which is included in the rotating blade noise reduction device according to the embodiment. The rotating blade noise reduction device will be described in detail in the second and subsequent embodiments.

The following will exemplify the optimal installation positions of the reference microphone in the rotating blade noise reduction device separately in two cases, namely a case in which the control loudspeaker count is 2M+1 to 2M+2 and a case in which the control loudspeaker count is 2M+3 or more.

According to the above literature "Active control of fan noise in a free field based on the spherical harmonic expansion", when a plurality of control loudspeakers are arranged on a circumference, sound pressures at a reference microphone point (r, θ, ϕ) are expressed as follows by a spherical harmonic expansion.

$$P(r, \theta, \phi, \omega, rp) = \sum_{n=0}^{inf} \sum_{m=-n}^{n} B_n^m(\omega) \left\{ \sum_{i=1}^{L} h_n(kr_i) Y_n^m(\theta, \phi) \right\} \tag{3}$$

where $B^m_n$ is a mode amplitude, $h_n$ is an n-order second class spherical Hankel function, $Y^m_n$ is spherical surface harmonics, ω is the angular frequency of vibrations, rp is a rotation, ring radius, k is a wavenumber, and L is a loudspeaker count. In addition, $r_i$ is represented by the following equation;

$$r_i = \|(r \sin(\theta)\cos(\phi), r \sin(\theta)\sin(\phi), r \cos(\theta)) - rp \times (\cos \phi_i, \sin \phi_i, 0)\| \tag{4}$$

where $r_i$ is the distance from one point on discrete ring sound sources to the reference microphone.

<Case of 2M+3 or More>

According to the above literature "Active control of fan noise in a free field based on the spherical harmonic expansion", when 2M+3 or more control loudspeakers are used, the only main mode is the one represented by (m, n)=(M, M), and the control loudspeakers generate only sounds in the same mode as that of the continuous ring sound source as the main sound source. Consequently, the installation position of the reference microphone may be set to a position at which the difference between the sound pressure distribution, generated by a main sound source with a ring radius a and a complex constant multiple of the sound pressure distribution generated by a control sound source with a ring radius b is minimized.

In this case, ϕ is symmetric with respect to the ring sound source, and hence may be an arbitrary constant (ϕ=0 this time). It is preferable to set r to a value larger than the control ring radius b so as to avoid the influence of the near field of the single control loudspeaker. With regard to the elevation angle θ as the remaining element, that term in equation (3) which depends on the elevation angle θ is T(r, rp, θ) defined as follows:

$$T(r, rp, \theta) = \left\{ \sum_{i=1}^{L} h_M(kr_i) P_M^M(\cos(\theta)) \right\} \tag{5}$$

where $P^m_n$ is an associated Legendre function. The elevation angle θ that minimizes an evaluation function $J(r, \theta_0)$ given below is determined, and an optimal installation position point (r, θ, ϕ) of the reference microphone at the elevation angle is determined.

$$J(r, \theta_0) = \sum_{\theta} \{\|T(r, a, \theta) - k_b(\theta_0) \times T(r, b, \theta)\|\} \tag{6}$$

where $k_b(\theta_0)$ is a complex constant that satisfies the following equation:

$$\|T(r,a,\theta_0)\| = k_b(\theta_0) \times \|T(r,b,\theta_0)\| \tag{7}$$

Figure 3:
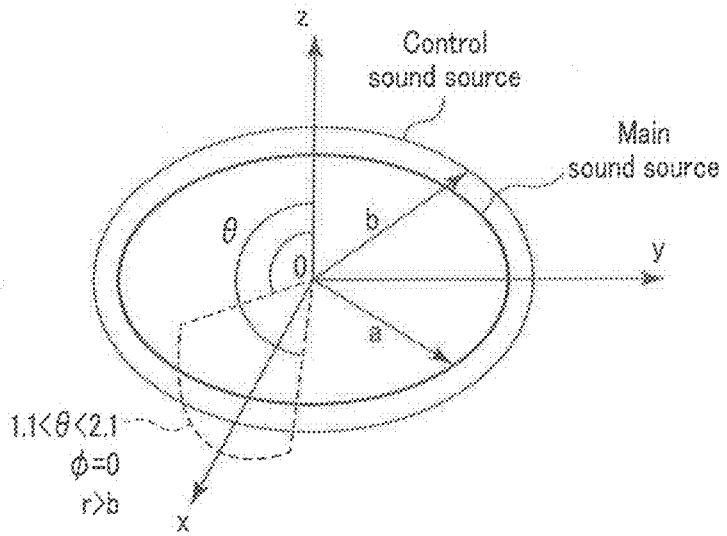
FIG. 3 is a view showing the installation position of a reference microphone when the count of control loudspeakers is equal to or more than 2M+3 according to the first embodiment.

The elevation angle θ that minimizes the evaluation function ranges from 1.1 to 2.1 rad (radians) (see FIG. 3). In this range, because the value of the evaluation function J represented by equation (6) is also small, the reference microphone may be installed at θ=π/2, that is, on the same plane as the ring sound source, for the sake of convenience.

Example 1

Equation (6) representing the evaluation function is examined under the following conditions:

the ring-like sound source count: 36 (the main sound sources are also counted as discrete ring sound sources for the sake of convenience)

the control sound source count: 10 the main sound source ring radius a: 0.38 m the control sound source ring radius b: 0.45 m the reference microphone position: (r, θ, ϕ)=(0.7, θ, 0)

r=0.7 m
the blade count: B=2
the order under consideration: x=1
the angular frequency: $\Omega=45\times2\times\pi$
the mode under examination: (n, m)=(M, M)=(2, 2)

Figure 4A:
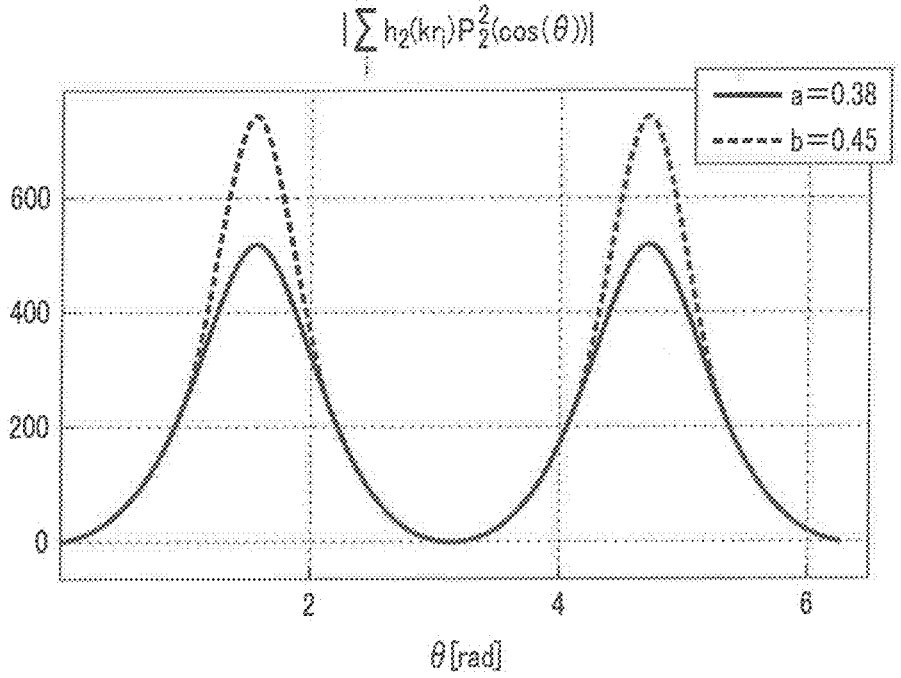
FIG. 4A is a graph plotting, as an example, the absolute values based on equation (5) with an elevation angle as a variable under the conditions shown in FIG. 3.
Figure 4B:
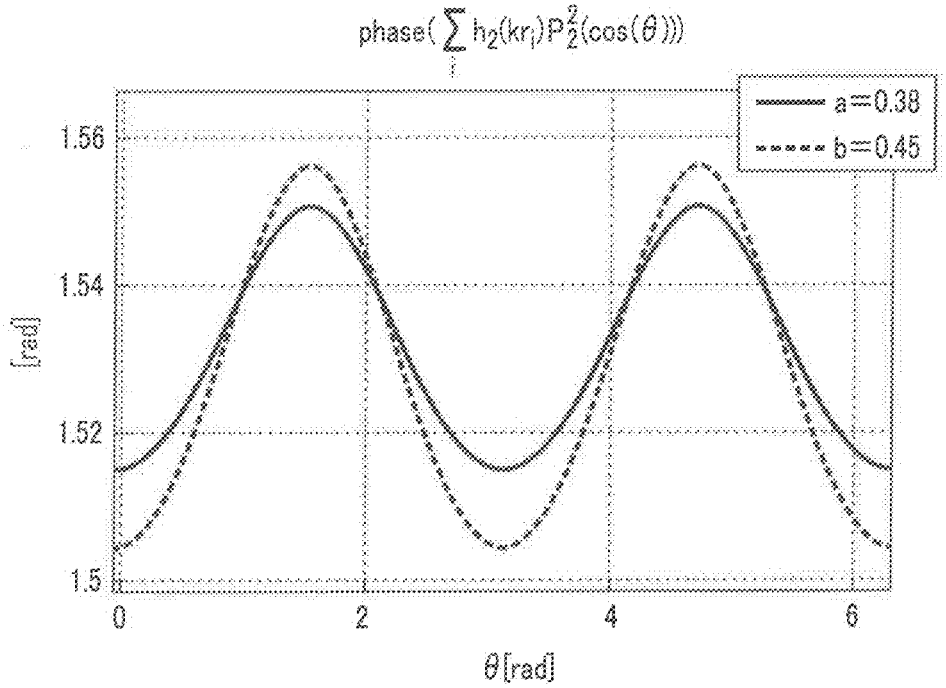
FIG. 4B is a graph plotting, as an example, the phases based on equation (5) with an elevation angle as a variable under the conditions shown, in FIG. 3.
Figure 5:
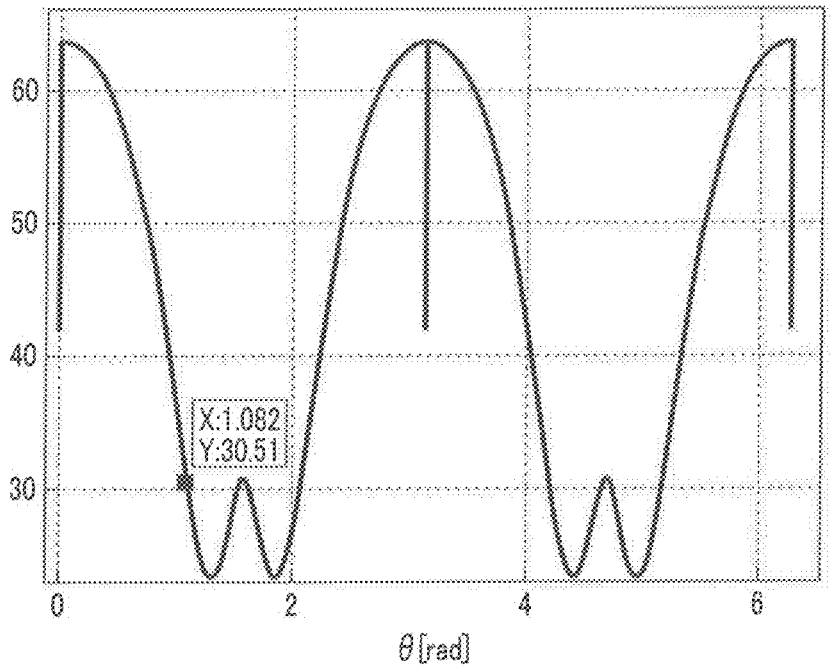
FIG. 5 is a graph plotting equation (6) with an elevation angle as a variable in Example 1.
Figure 6:
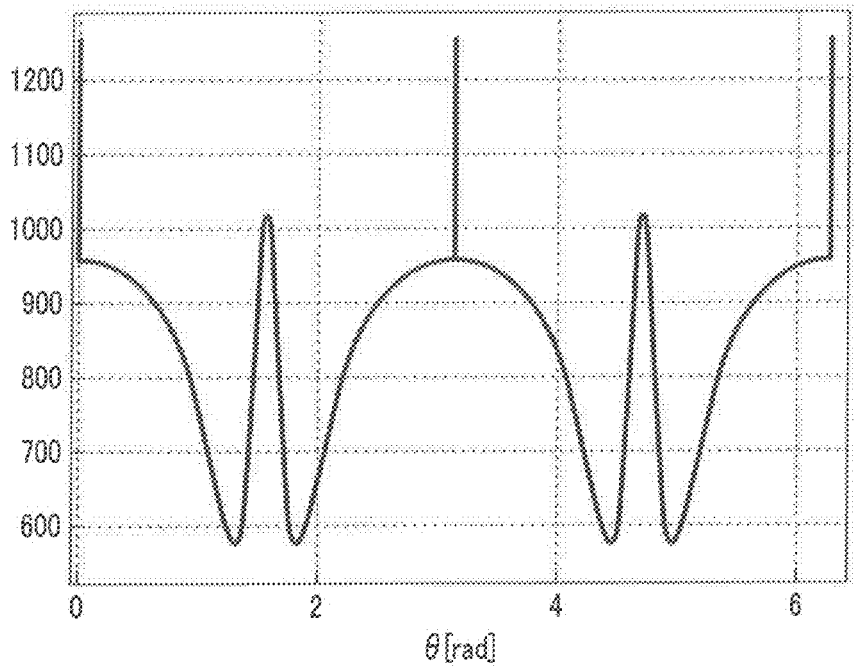
FIG. 6 is a graph plotting equation (6) with an elevation angle as a variable in a case in which the reference microphone position is changed to a position near the main sound source in Example 1.
Figure 7:
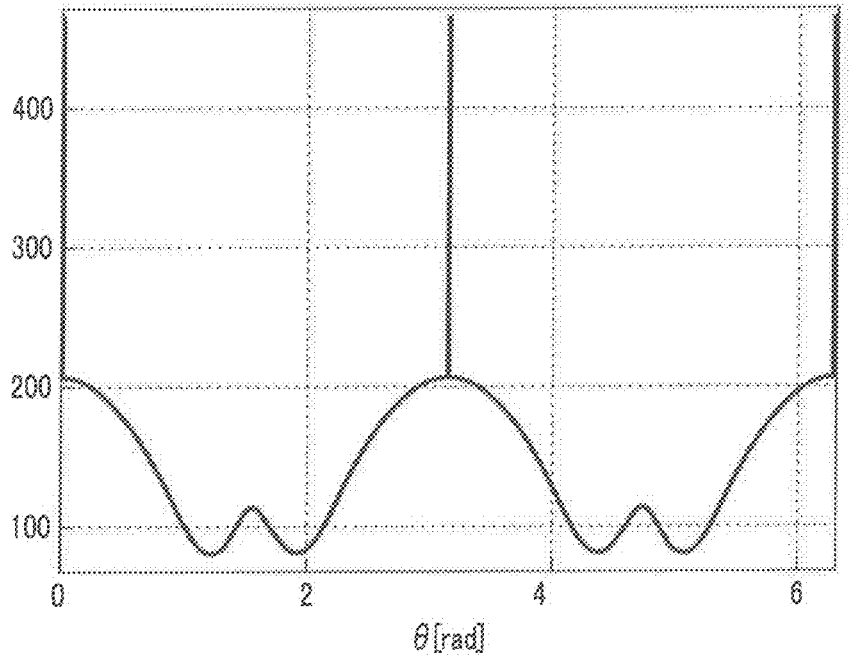
FIG. 7 is a graph plotting equation (6) with an elevation angle as a variable in a case in which the reference microphone position is changed to a position inside the main sound source ring in Example 1.

FIG. 4A shows the comparison between plots of the absolute values respectively given by equation (5) with the radii a and b. FIG. 4B shows the comparison between plots of the phases respectively given by equation (5) with radii a and b. FIG. 5 is a plot of equation (6). FIG. 5 indicates that the above reference microphone location (the elevation angle θ is approximately set to 1.1 to 1.2 rad) exhibits validity.

In contrast to this, assume that the microphone is installed near the main sound source or the control sound source for certain reasons. In this case, when, for example, r=0.3, because the result shown in FIG. 6 appears, the microphone is preferably installed at 85 deg (about 1.43 rad) or less. In addition, obviously, when the microphone is installed near the main sound source or the control sound source, setting θ=about 1.6 will increase the value given by equation (6). This is because, when the microphone is installed on the same plane as the ring sound source, the sound pressure gradient abruptly changes near the ring radius, and it is difficult to match the wavefronts of sound waves from the ring sound source and the control sound source.

In addition, when the microphone is installed further inside, at, for example, r=0.2 (FIG. 7), the elevation angle θ is set to about 1.1 to 2.1 rad as when the microphone is installed outside. Note that because a larger noise reduction effect can be obtained when wavefronts are matched outside the sound source ring than when they are matched inside (see, for example, the above literature "Active Minimization of Blade Rotational Noise from an Axial Fan"), the microphone is preferably installed outside the sound source ring to improve the noise reduction effect in the overall space.

<Case of 2M+1 to 2M+2>

When the control loudspeaker count is 2M+1, the influence of the aliasing modes indicated by the above literature "Active Minimization of Blade Rotational Noise from an Axial Pan" is generated in amount corresponding to several percent in the (|M−L|, M−L) mode. For example, under the conditions in Example 1, aliasing modes appear, and have a contribution ratio of 14% when the loudspeaker count is 5 as indicated by Table 2.

TABLE 2

| | (n, m) | | | |
|---|---|---|---|---|
| SP Count | (2, 2) Mode Contribution Ratio (%) | (3, −3) Mode Contribution Ratio (%) | (4, 2) Mode Contribution Ratio (%) | (4, −4) Mode Contribution Ratio (%) |
| 5 | 84.90% | 13.90% | 1% | |
| 6 | 96.78% | | 1.20% | 2% |
| 7 | 98.58% | | 1.18% | |
| 8 | 98.78% | | 1.18% | |

When the aliasing modes of control loudspeakers have a large influence at the reference microphone point, the rotating blade noise reduction device reduces noise at the reference microphone by using modes which do not belong to the continuous ring. As a result, the noise reduction effect in the overall space deteriorates. For this reason, in the present embodiment, the installation position of the reference microphone is determined so as to avoid the influence of aliasing modes and minimize the evaluation value given by equation (6). In this case, for the sake of simplicity, the following equation will be considered which is associated with θ and a mode in the spherical surface harmonics represented by equation (3).

$$Q(n,m) = \|P_n^{|m|}(\cos(\theta))\| \times \frac{2n+1}{(n+|m|)!} \tag{8}$$

The following ratio will be examined from this equation:

$$Q(|M-L|,M-L)/Q(M,M) \tag{9}$$

Figure 8:
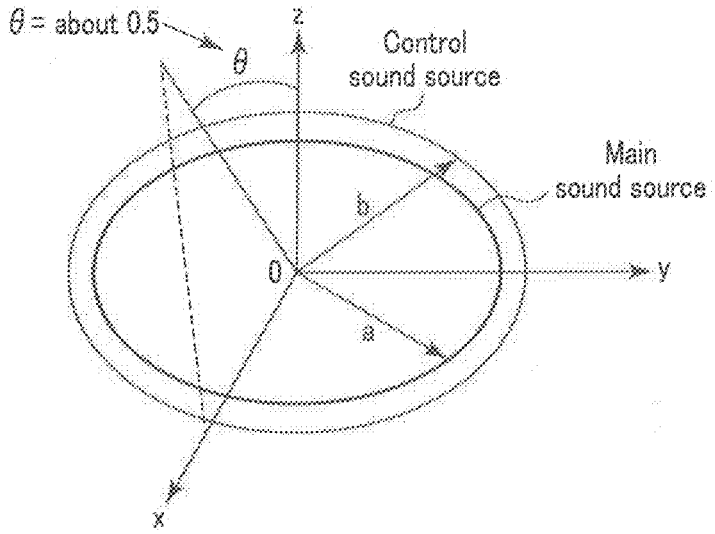
FIG. 8 is a view showing the installation position of the reference microphone when the control loudspeaker count (i.e., the number of the control loudspeakers) is 2M+1 to 2M+2 according to the embodiment.

Equation (9) indicates the influence degree of the aliasing mode (|M−L|, M−L) relative to the main mode (M, M). Consequently, the lower the value of equation (9), the better, and in general, the smaller the value of θ, the better. Note, however, that increasing θ will increase the evaluation value given by equation (6). That is, there is a tradeoff relationship between the optimal location of a microphone for constraining the acquisition of aliasing modes and the optimal location of a microphone for bringing the main mode close to the main sound source. For this reason, the present embodiment uses θ that makes equation (9) produce about 0.5. In this case, the approximate installation position of the reference microphone is farther from the center of the ring than the upper space inside the control ring, and θ=about 0.5 is set (FIG. 8). In the present embodiment as also indicated by Example 3 and Example 6 (to be described later), the location of the reference microphone is set to achieve a noise reduction of 10 dB or more near the reference microphone. In this case, $0.3<\theta<0.7$ is the range of reference microphone positions. The range of θ varies depending on the degree of attenuation near the reference microphone. The higher the attenuation ratio, the narrow the range of θ becomes.

Figure 9:
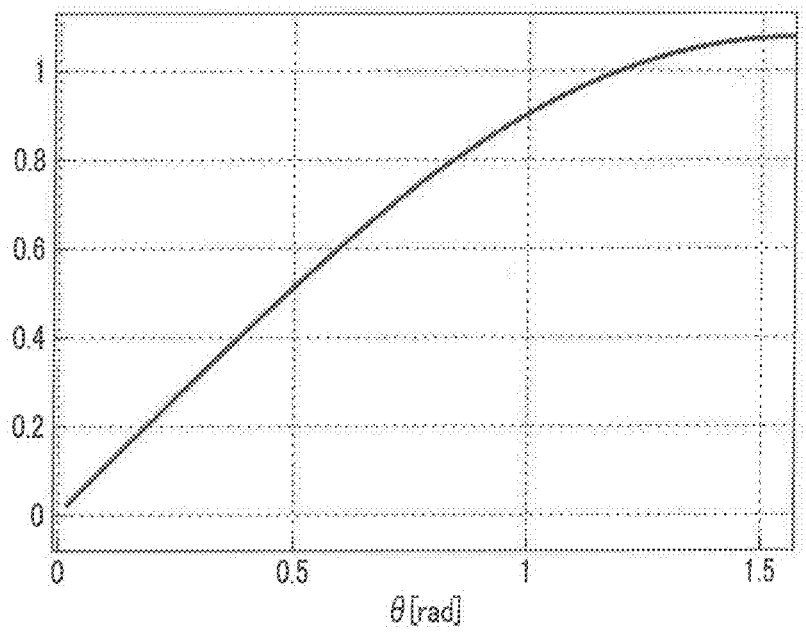
FIG. 9 is a graph plotting equation (9) with an elevation angle as a variable in Example 2.

In [Example 2], when the control loudspeaker count (the control sound source count) in the conditions in Example 1 is set to five, the result given by equation (9) is plotted on the graph of FIG. 9. Obviously, as θ increases, the influence of aliasing modes increases. It is therefore preferable to set θ=about 0.5 corresponding to a ratio of about 0.5. The above description has exemplified the two cases concerning the reference microphone position in the rotating blade noise reduction device according to the present embodiment.

According to the first embodiment described above, it is possible to determine at which position the reference microphone of the rotating blade noise reduction device according to the embodiment should be arranged to effectively reduce noise. This makes it possible to arrange the reference microphone of the rotating blade noise reduction device at an optimal position.

Second Embodiment (Rotating Blade Noise Reduction Device)

Figure 10:
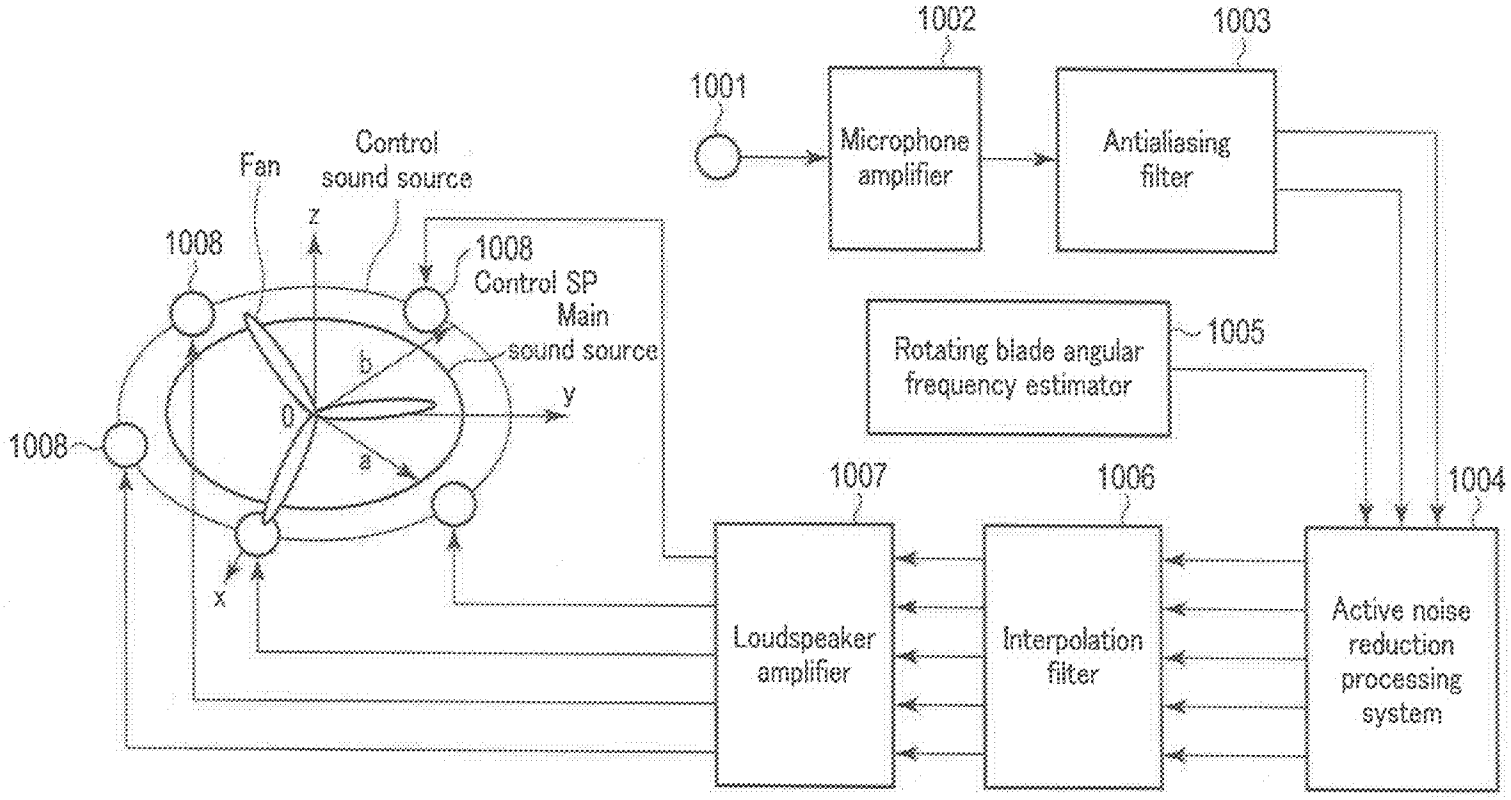
FIG. 10 is a block diagram showing a rotating blade noise reduction device according to the second embodiment.

As shown in FIG. 10, a rotating blade noise reduction device according to the present embodiment includes a reference microphone 1001, a microphone amplifier 1002, an antialiasing filter 1003, an active noise reduction processing system (also called an active noise reduction unit) 1004, a rotating blade angular frequency estimator 1005, an interpolation filter 1006, a loudspeaker amplifier 1007, and control loudspeakers 1008. The rotating blade noise reduction, device according to the present embodiment reduces noise from a flight vehicle having a plurality of rotating blades.

The reference microphone 1001 is arranged at the position determined by a technique according to the present embodiment, detects a sound wave, and converts it into an electrical signal. The reference microphone 1001 acquires the noise generated from a plurality of rotating blades and the control sounds generated from the plurality of loudspeakers. Note that the reference microphone 1001 is also called an error microphone.

The microphone amplifier 1002 amplifies the electrical signal output from the reference microphone 1001.

The antialiasing filter 1003 is a low pass filter having cutoff frequencies adjusted to the active noise reduction processing system 1004 on the subsequent stage.

The active noise reduction processing system 1004 controls signals respectively output to the control loudspeakers 1008 to control the sounds output from the control loudspeakers 1008, based on the signal output from the antialiasing filter 1003, so as to cancel the noise received by the reference microphone 1001. The active noise reduction processing system 1004 generates control signals to reduce sound pressures at the reference microphone. The active noise reduction processing system 1004 then delays the control signals by time delays corresponding to the respective loudspeakers dependent on the installation angles between the loudspeakers arranged coaxially in a circumferential form from the circle center, the angular frequencies, and the loudspeaker count, and inputs the control signals to the corresponding loudspeakers.

The rotating blase angular frequency estimator 1005 estimates the angular frequencies of the rotating blades of the flight vehicle as a noise source. For example, the rotating blade angular frequency estimator 1005 uses command values to a rotating blade driving motor or rotating device, or estimates an angular frequency from generated noise or generated wind velocity and transfers the angular frequency to the active noise reduction processing system 1004.

The interpolation filter 1006 is a low pass filter having cutoff frequencies adjusted to outputs from the active noise reduction processing system 1004.

The loudspeaker amplifier 1007 outputs a plurality of electrical signals output from the interpolation filter 1006 to the corresponding control loudspeakers 1008 upon amplifying the signals in accordance with the corresponding control loudspeakers 1008.

The control loudspeakers 1008 are arranged coaxially in a circumferential form with respect to the blades (fan) as noise reduction targets. The control loudspeakers 1008 generate sounds controlled by the active noise reduction processing system 1004 at their positions. The control loudspeakers 1008 are arranged coaxially in a circumferential form for the respective rotating blades.

The active noise reduction processing system 1004 will be described in detail next with reference to FIG. 11A.

Unlike general rotating blade noise reduction devices, the active noise reduction processing system 1004 according to the present embodiment includes phase adjusters 1101 in correspondence with the control loudspeakers 1008. That is, the phase adjusters 1101 respectively receive control input signals, adjust the phases of the control input signals in accordance with the corresponding control loudspeakers 1008, and output the adjusted signals to the corresponding control loudspeakers 1008. The phase adjusters 1101 respectively apply phase adjustment corresponding to the following equation to control inputs, and distribute the resultant signals to the respective control loudspeakers 1008, which are a plurality of loudspeakers including a discrete ring sound source.

$$d_i=2\pi l/(L_c\Omega) \tag{10}$$

The phase adjusters 1101 apply phase adjustment corresponding to the above equation (signal delays di (i=1, . . . , Lc) where Lc is the control loudspeaker count) to control inputs and distribute the resultant signals. In this case, the loudspeaker numbers of the control loudspeakers 1008 are arranged in the rotating blade rotation direction, as shown in FIG. 11B. In addition, in equation (10), because rotating blade angular frequencies Ω are used, the phase adjusters 1101 need to be naught the rotating blade angular frequencies Ω from the rotating blade angular frequency estimator 1005. Note that the rotating blade angular frequency estimator 1005 may or not may be included in the active noise reduction processing system 1004. Furthermore, although FIG. 11A shows the phase adjusters 1101 as delay elements, when the respective loudspeakers have individual differences, individual difference correction filters corresponding to the respective control loudspeakers 1008 may be added to the right hand side of equation (10), and the phase adjusters 1101 may incorporate the filters. These individual difference correction filters may be installed at any positions between the phase adjusters 1101 and the control loudspeakers 1003.

Because the noise generated from an airfoil fan is x-fold periodic noise having a blade pass frequency ΩB as indicated by equation (1), it suffices to use an active noise reduction processing system using an adaptive feedback or single adaptive notch filter scheme. However, for rotating blades subjected to fast spin-up or spin-down, it is preferable to use a feedforward type active noise reduction processing system which uses reference signals as command values for a rotating blade driving motor or rotating device. In consideration of high controllability, simple filter structure, and light calculation load, the following will exemplify a system configuration using the single adaptive notch filter scheme. A rotating blade noise reduction device according to the present embodiment in this case will be described with reference to FIGS. 12 and 13.

Figure 12:
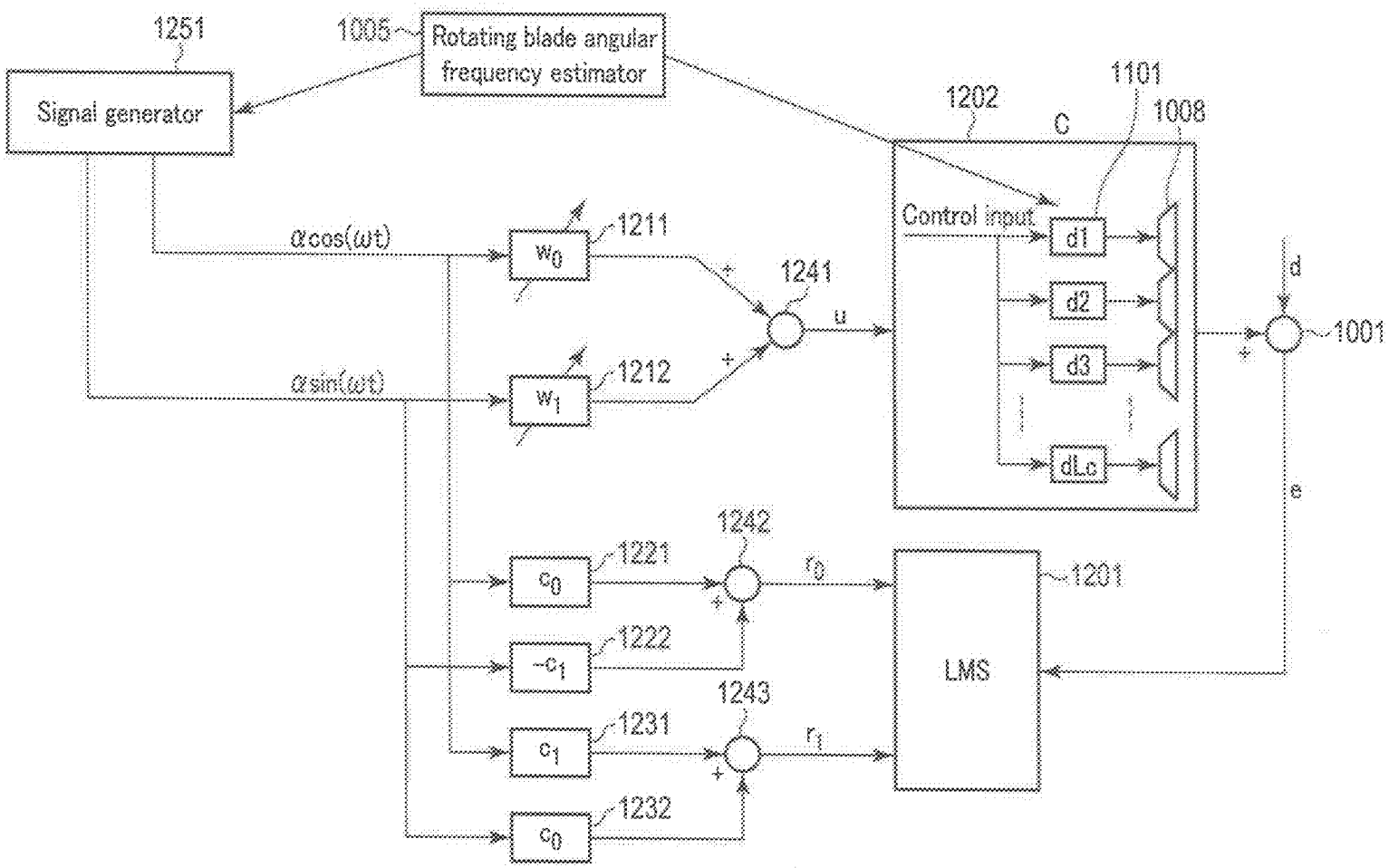
FIG. 12 is a block diagram showing an example of a rotating blade noise reduction device according to the second embodiment.

First of all, FIG. 12 shows an outline of the rotating blade noise reduction device using the single adaptive notch filter scheme for reducing one period sound (ω=Ω×M). This technique features light calculation load and high adaptation speed because only-two variables ($w_0$ and $w_1$) are to be adaptively updated. The sinusoidal signals (α cos(ωt) and α sin(ωt)) in FIG. 12 may be generated inside the processing system or generated by an external generator. In the present embodiment, the rotating blade angular frequency estimator 1005 estimates Ω, and a signal generator 1251 receives Ω and generates a sinusoidal signal of a periodic sound ω. The signal generator 1251 derives the angular frequency ω of the sinusoidal signal based on the information Ω from the rotating blade angular frequency estimator 1005.

Figure 11A:
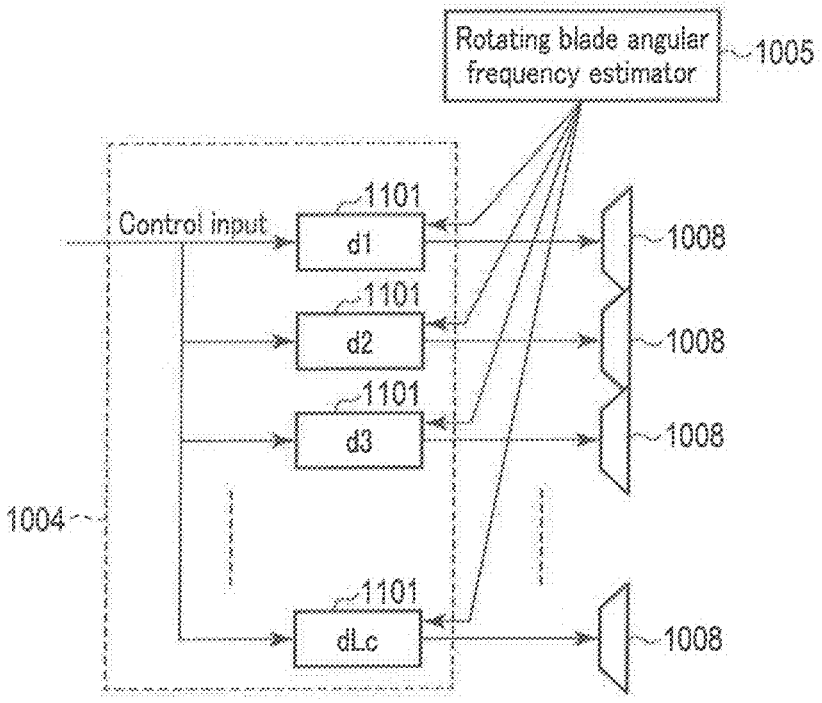
FIG. 11A is a block diagram showing an active noise reduction processing system shown in FIG. 10 and including a phase adjuster and its peripheral portions.
Figure 11B:
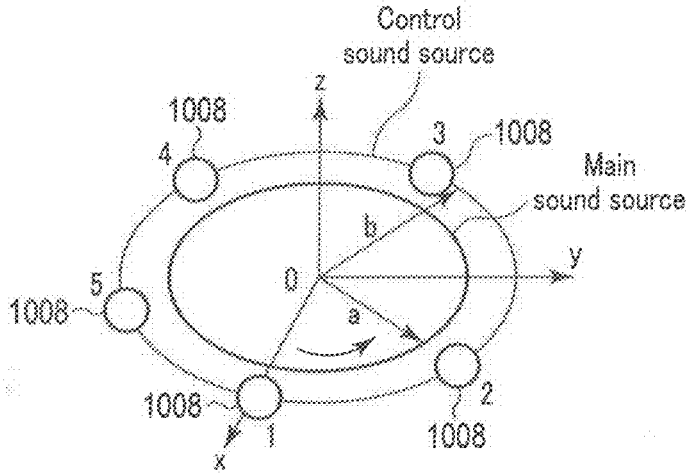
FIG. 11B is a view showing the arrangement of control loudspeakers in FIG. 11A.

The rotating blade noise reduction device according to the present embodiment features that a secondary path characteristic C is a transfer characteristic from a control input u to the reference microphone 1001 and includes a delay element, to each loudspeaker shown in FIG. 11A. In this case, $c_0$ and $c_1$ respectively represent a real part and imaginary part of the secondary path characteristic corresponding to the target frequency ω. Constant updating formulae are expressed by the following two equations. In this case, $r_0$ represents the signal obtained by adding output signals from filters 1221 and 1222, and $r_1$ represents the signal obtained by adding output signals from filters 1231 and 1232. The following are constant updating formulae. In this case, e represents an error signal.

$$w_0(t+1)=w_0(t)-2\mu e r_0/(r_0^2+r_1^2) \tag{11}$$

$$w_1(t+1)=w_1(t)-2\mu e r_1/(r_0^2+r_1^2) \tag{12}$$

Note that the reference microphone 1001 converts a sound in a space which includes a control sound from each loudspeaker and noise into the error signal e. For example, the reference microphone 1001 detects a composite sound pressure of noise from a noise source and a control sound from each loudspeaker, and generates the error signal e representing the detected composite sound pressure. An analog/digital converter (not shown) is provided between an error microphone 104 and a signal processor (LMS) 1201. This analog/digital converter converts the error signal e into a digital signal and supplies it to the LMS 1201. The LMS 1201 adoptively controls a control filter 202 based on the error signal e. More specifically, the signal processor 1201 updates the filters 1211 and 1212 so as to minimize an evaluation function based on the error signal e.

In this case, at the time of periodic noise reduction, the updating speed of constant updating often increases to cause divergence. For this reason, the present embodiment uses the arrangement shown in FIG. 13 to constrain divergence and implement fast convergence. The rotating blade noise reduction device according to the present embodiment shown in FIG. 13 features performing control so as not to excessively increase the difference between a signal z and a signal w. This implements sufficiently fast adaptive updating even when a secondary path characteristic includes many delay characteristics. In the present embodiment, the delay element count increases depending on the individual difference correction filters of the respective control loudspeakers 1008 and the installation position of the reference microphone 1001.

In this case, the following updating formulae are used, where e(t) represents an error signal:

$$w_0(t+1)=w_0(t)-2\mu(e(t)-(z(t)-w(t)))r_0(t)/(r_0^2+r_1^2) \quad (13)$$

$$w_1(t+1)=w_1(t)-2\mu(e(t)-(z(t)-w(t)))r_1(t)/(r_0^2+r_1^2) \quad (14)$$

(Simulation Results)

[Example 3] (Case of 2M+1)

In a case in which the count of control loudspeakers 1008 is 2M+1, the following are the simulation results obtained when the position of the reference microphone 1001 is set to (r, θ, ϕ)=(0.6, 0.5, 0) in consideration of the above examination results. Simulation conditions are set as follows;

the ring-like main sound source count: 36 (the main sound sources are also counted as discrete ring sound sources for the sake of convenience)

a main sound source ring radius a: 0.38 m the ring-like control sound source count: 5 a control sound source ring radius b: 0.45 m the reference microphone position: (r, θ, ϕ)=(0.6, 0.5 0)

the blade count: B=2 the order under consideration: x=1 the angular frequency: Ω=45×2×π

Figure 14A:
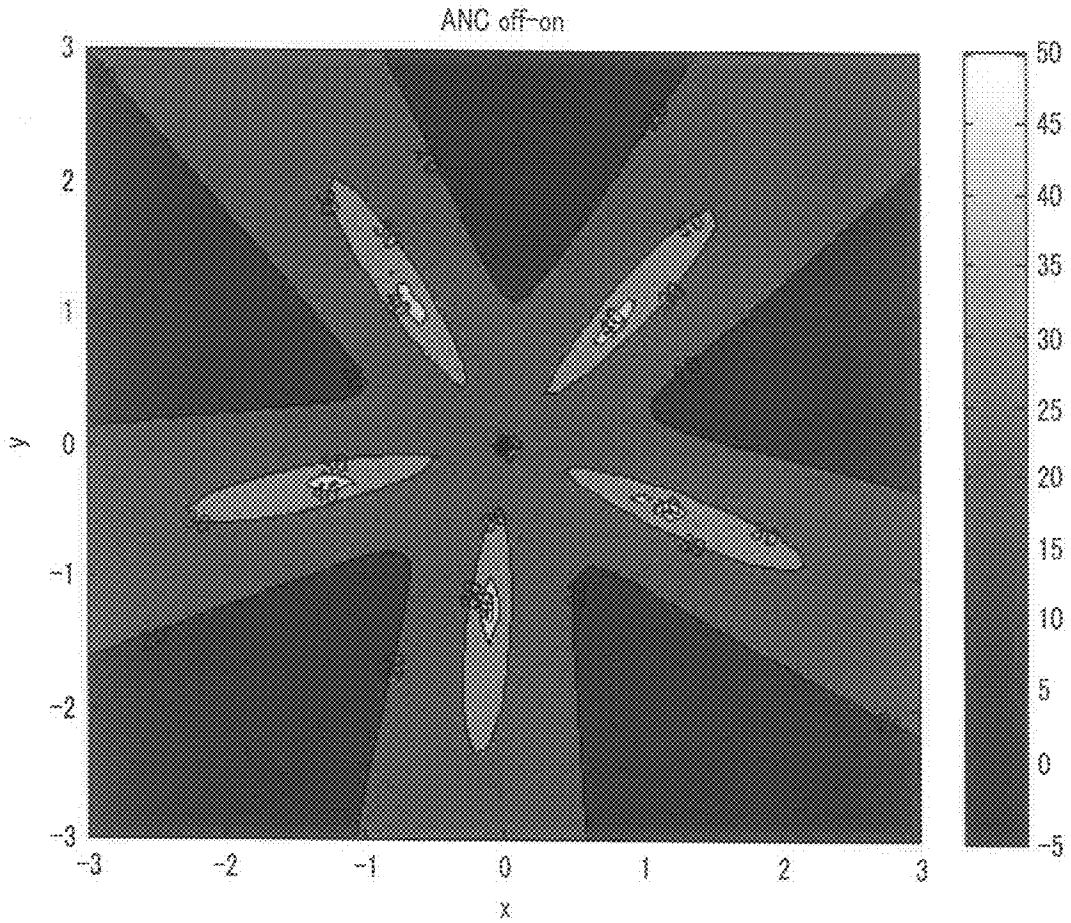
FIG. 14A is a graph showing the distribution of active noise reduction amount sound pressures 3 meters above the plane on which a main sound source and a control sound source ring are arranged in Example 3.

FIG. 14A shows the distribution of active noise reduction amount sound pressures 3 meters above the plane on which the blades of the multirotor flight vehicle, the main sound source ring, and the control sound source ring are installed. The horizontal axis and the vertical axis represent two orthogonal axes x and y of a two-dimensional plane parallel to the plane on which the blades of the multirotor flight vehicle are installed. Note that the sound pressure distribution graphs of FIG. 14A and the subsequent drawings indicate larger noise reduction amounts by lighter color tones. It is obvious from FIG. 14A that a noise reduction effect of 30 dB to 40 dB appears near each blade, and a noise reduction effect of over 20 dB appears almost all area. In addition, although not directly observable from FIG. 14A, a simulation result indicates that the noise reduction amount at a far point (12, 12, 12) (=(x, y, z)) is 22.6 dB.

Figure 14B:
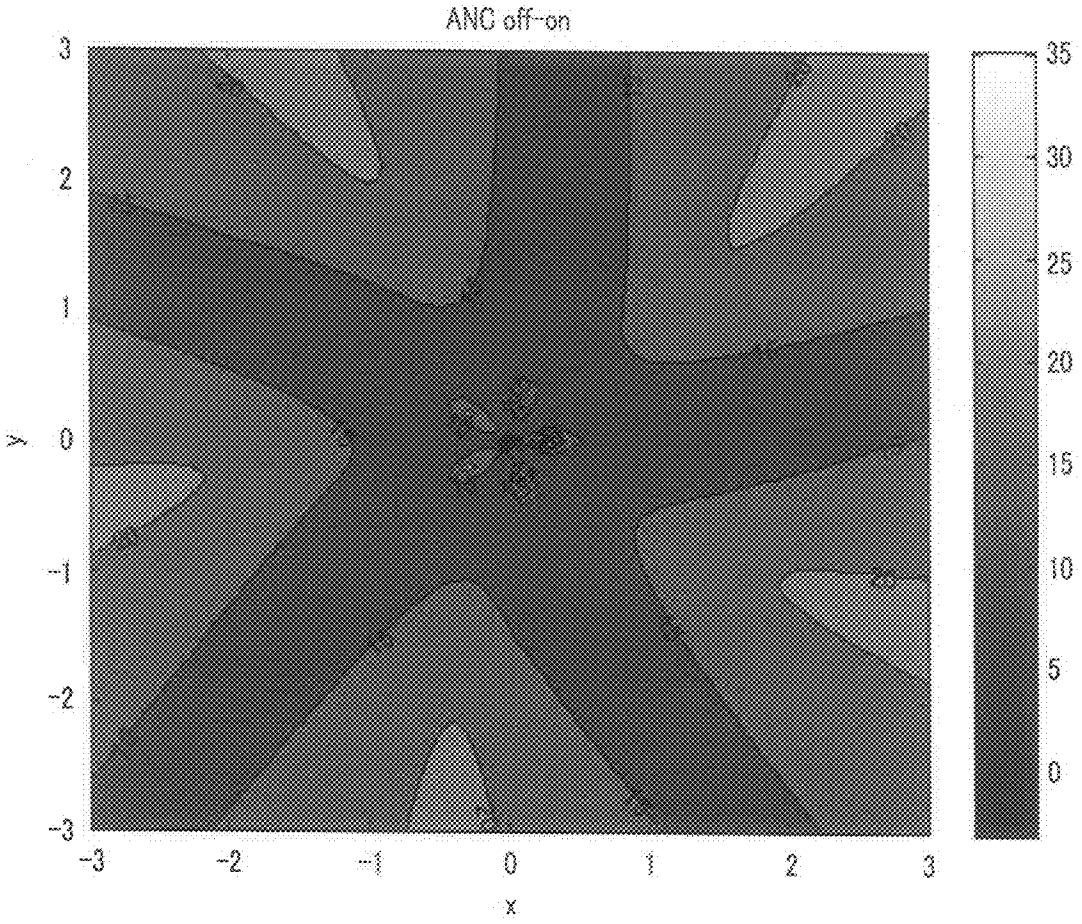
FIG. 14B is a graph showing the distribution of active noise reduction amount sound pressures on an x-y plane including the installation position of a reference microphone in Example 3.

Meanwhile, FIG. 14B shows a control effect sound pressure distribution on an x-y plane including the installation position of the reference microphone 1001. In this case, the x-y plane is parallel to the plane on which the blades of the multirotor flight vehicle are installed. In FIG. 14B, like FIG. 14A, the horizontal axis and the vertical axis represent two orthogonal axes x and y of a two-dimensional plane parallel to the plane on which the blades of the multirotor flight vehicle are installed. Because the reference microphone 1001 is set at r=0.6 meters, the sound pressure distribution shown in FIG. 14B is closer to the plane on which the blades of the flight vehicle are installed than the sound pressure distribution shown in FIG. 14A.

It is obvious from FIGS. 14A and 14B that five characteristic sound pressure distribution gradients corresponding to the loudspeaker locations have appeared. These sound pressure distribution gradients have appeared due to the influence of aliasing modes. Using a small control loudspeaker count will lead to a reduction amount distribution dependent on loudspeaker installation positions, with the reduction amount sound pressure distribution being non-uniform. However, because the overall reduction amount is 22.6 dB, it can be said that the rotating blade noise reduction device according to the present embodiment and this installation position of the reference microphone provide a sufficient noise reduction function.

Figure 15A:
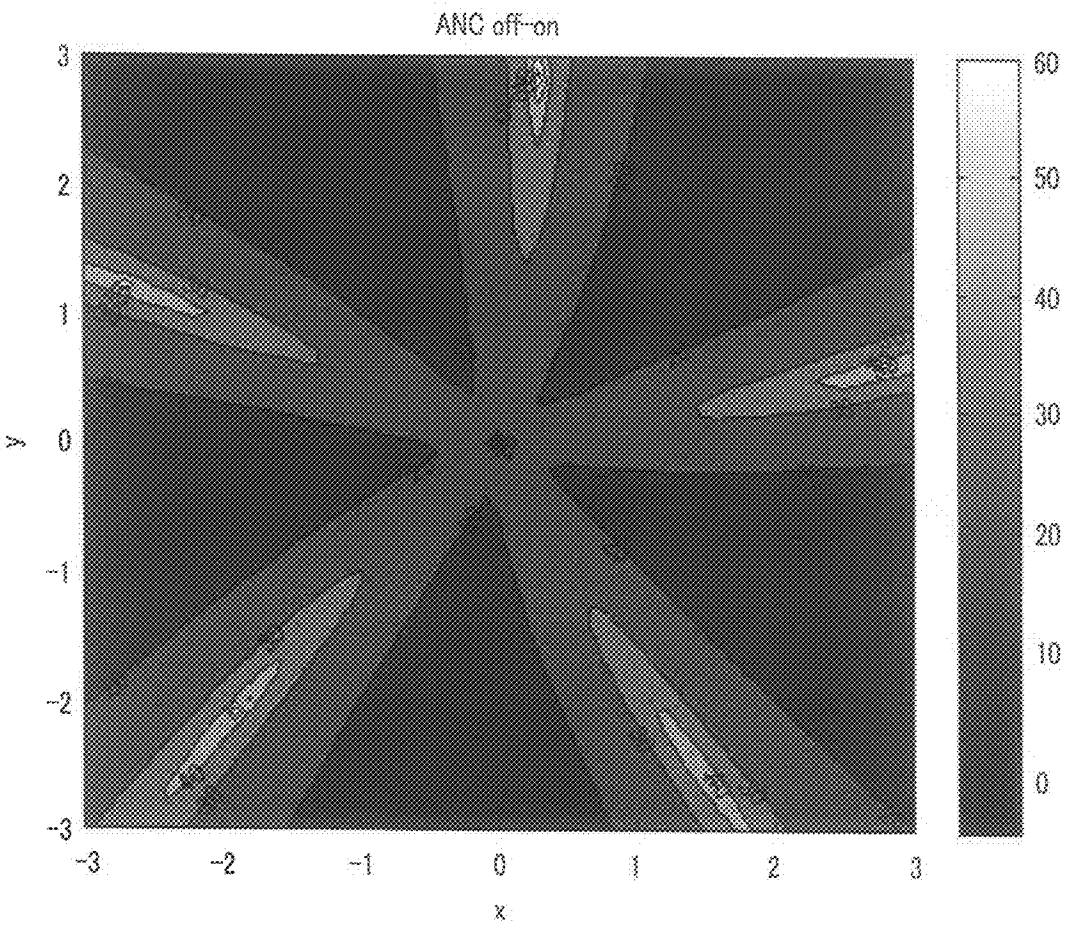
FIG. 15A is a graph showing the distribution of active noise reduction amount sound pressures 3 meters above the plane on which a main sound source and a control sound source ring are arranged when a reference microphone is not located at a proper position.
Figure 15B:
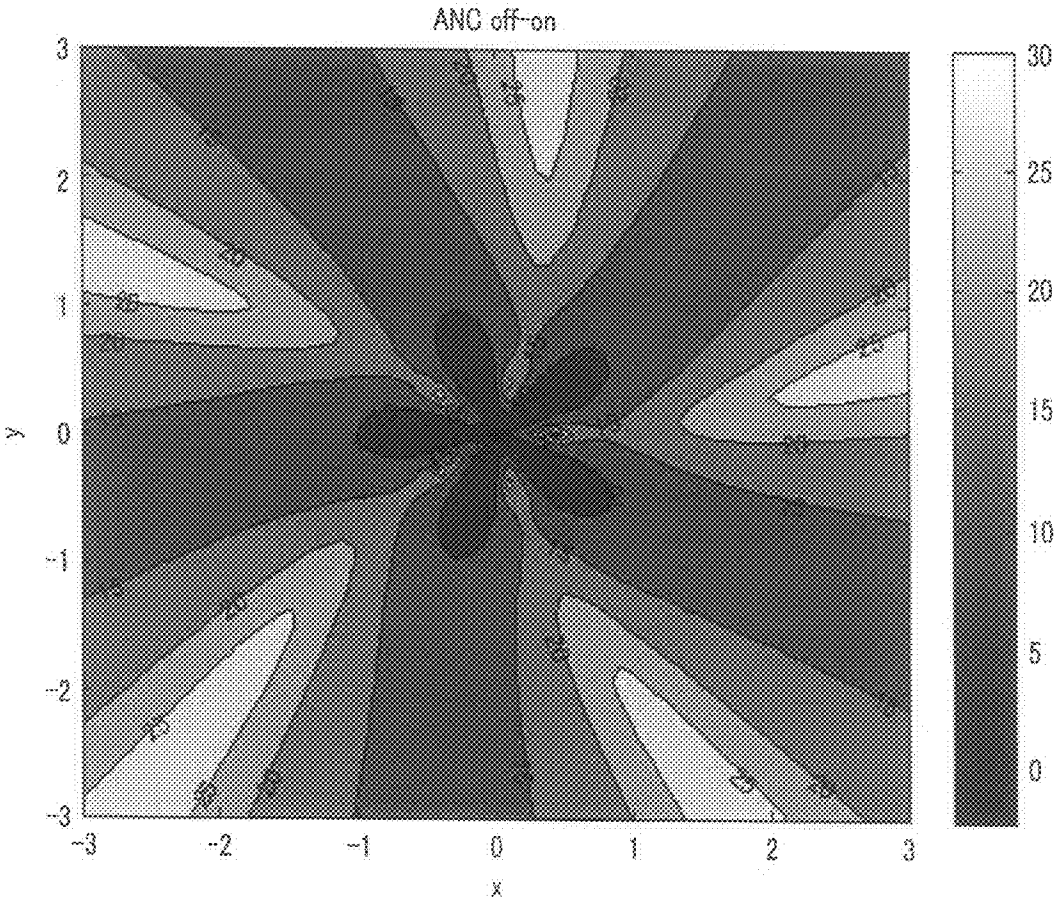
FIG. 15B is a graph showing the distribution of active noise reduction amount sound pressures on an x-y plane including the installation position of a reference microphone under the same conditions as those in FIG. 15A.

Note that, for reference, FIGS. 15A and 15B show the results obtained when the reference microphone position is set to (r, θ, ϕ)=(0.6, 0.8, 0), which is not appropriate as a reference microphone position in the present embodiment. FIGS. 15A and 15B show sound pressure distributions under the same conditions as those in FIGS. 14A and 14B except for the reference microphone position. In this case, the value of θ considerably deviates from the value of θ (0.5 radians) which should be set in the present embodiment. The comparison between FIGS. 14A and 14B and FIGS. 15A and 15B reveals that the control effects shown in FIGS. 14A and 14B which correspond to the preset embodiment are superior. In addition, the comparison between FIG. 15B and FIG. 14B reveals that the influence width of aliasing modes in FIG. 15B are larger. It is obvious from the above that the installation position of the reference microphone in the rotating blade noise reduction device according to the present embodiment is appropriate.

[Example 4] (Case of Loudspeaker Count Much Larger than 2M+2)

Figure 16A:
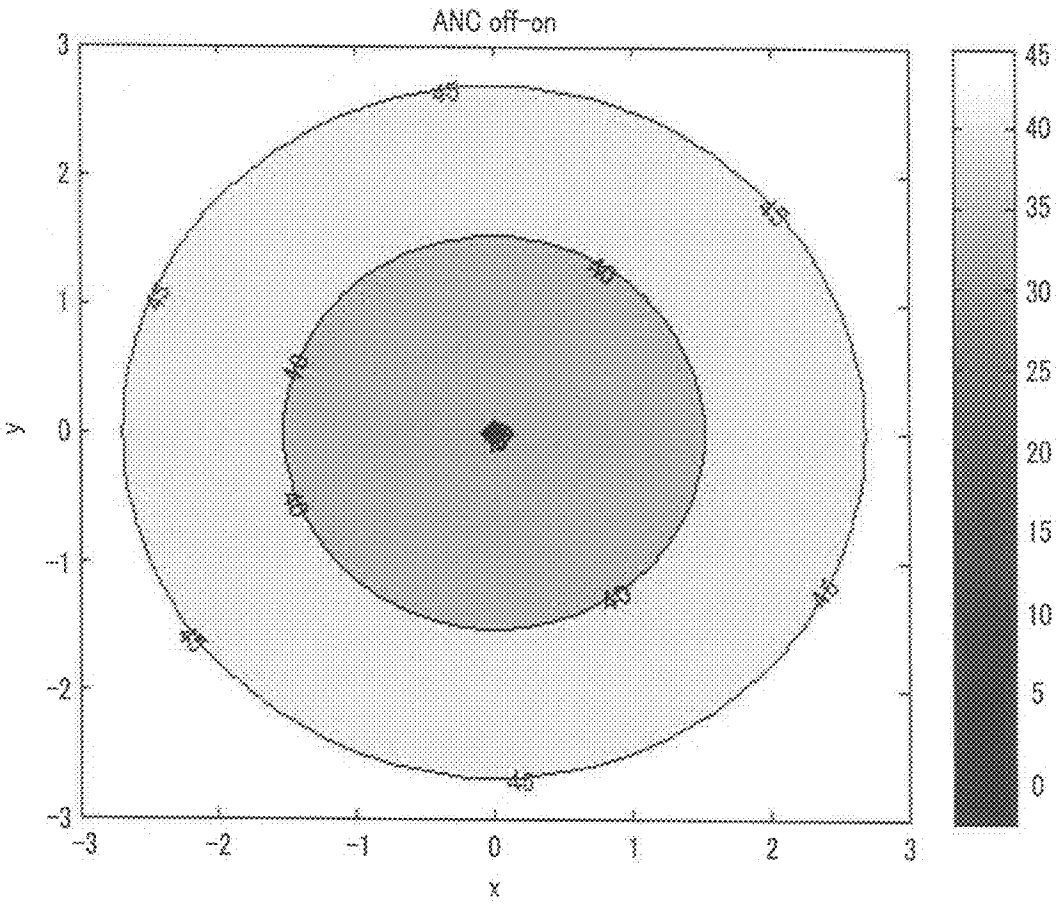
FIG. 16A is a graph showing the distribution of active noise reduction amount sound pressures 3 meters above the plane on which a main sound source and a control sound source ring are arranged in Example 4.
Figure 16B:
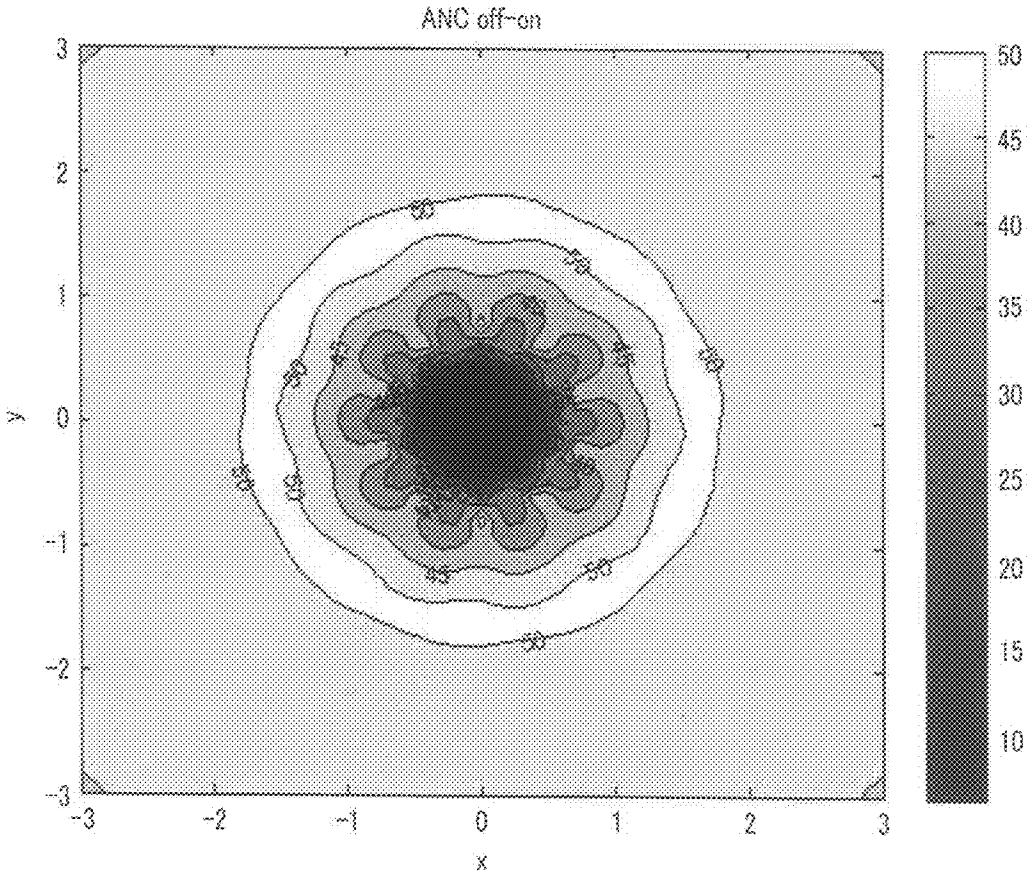
FIG. 16B is a graph showing the distribution of active noise reduction amount sound pressures on an x-y plane including the installation position of a reference microphone in Example 4.

An example in the case of control loudspeaker count; 10>>2M+2 will be described next. This case corresponds to "<case of 2M+3 or more>" described above, and the elevation angle θ that minimizes the evaluation function $J(r, \theta_0)$ is about 1.1 to 2.1 rad. In this case, FIGS. 16A and 16B show the results obtained when the reference microphone position is set to (r, θ, ϕ)=(0.6, 1.25, 0). Assume that the remaining simulation conditions are the same as those in (Example 3). It is obvious from FIG. 16A that a uniform noise reduction effect has appeared on a section at z=3 meters, which is farther than in (Example 3) with a small control loudspeaker count. In this case, the noise reduction amount at the far point (12, 12, 12) (=(x, y, z)) is 54.3 dB. It can be said from FIG. 16A that the distribution is almost symmetric with respect to the ring center, and the wavefronts of sound waves from the ring sound source and the control sound source exactly match each other.

FIG. 16B shows a control effect sound pressure distribution result, at the installation position of the reference microphone, on an x-y plane parallel to the plane on which the blades of the multirotor flight vehicle are installed. Obviously, the characteristics of the single control loudspeaker have appeared to some extent. This is because, when the reference microphone is installed near a control loudspeaker ((r, θ, ϕ)=(0.6, 1.25, 0)), an asymmetric distribution like that shown in FIG. 16B is generated due to the influence of the characteristics of the single loudspeaker (a large noise reduction amount near (0.57, 0)). However, the distribution shown in FIG. 16B is more symmetric with respect to the center than that shown in FIG. 15B, and hence the influence of the single loudspeaker is smaller than that in (Example 3). In addition, the comparison between FIG. 16A and FIG. 16B reveals that increasing the distance to the reference microphone (increasing r) will improve the control effect at the reference microphone.

Figure 17A:
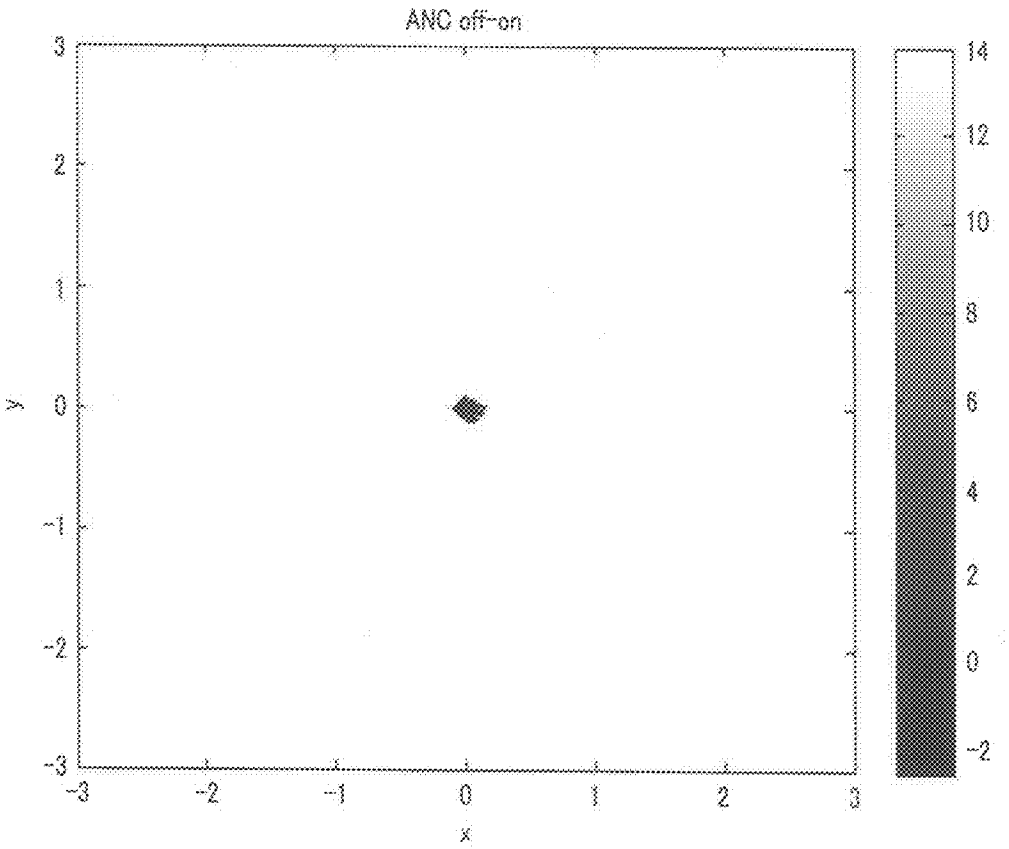
FIG. 17A is a graph corresponding to FIG. 16A when the elevation angle of the reference microphone is changed to 1.5 radians in Example 4.
Figure 17B:
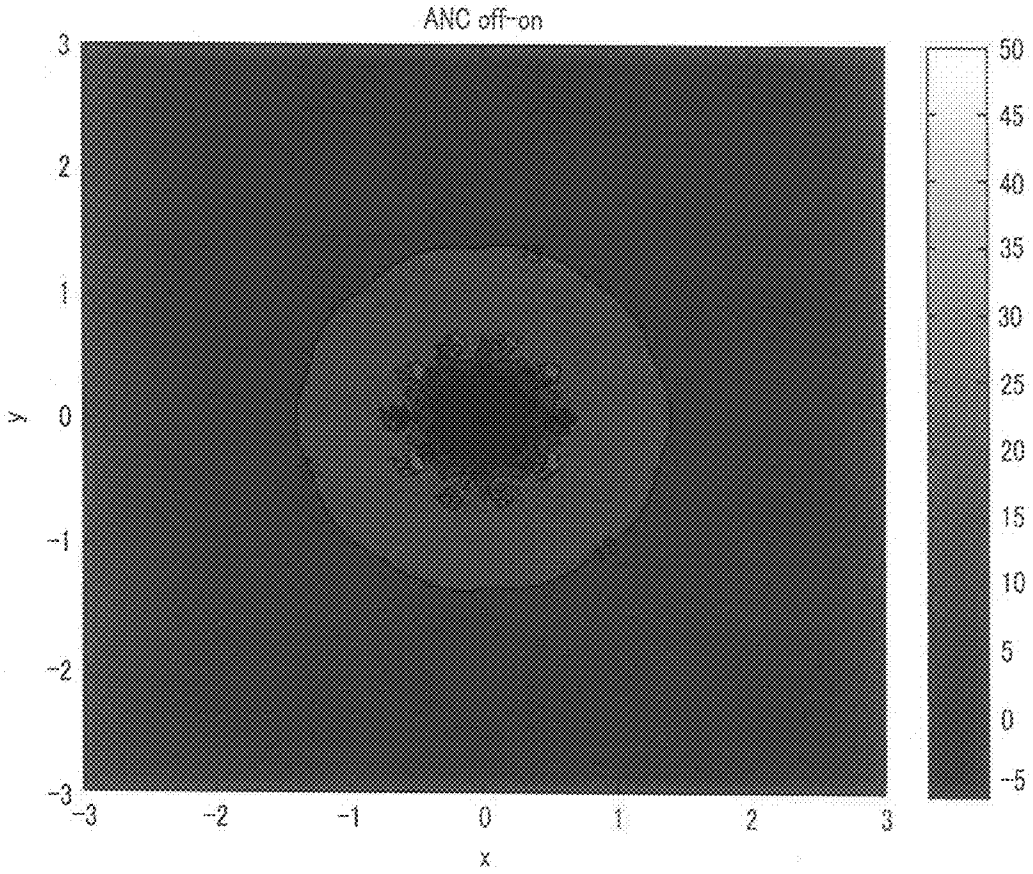
FIG. 17B is a graph corresponding to FIG. 16B when the elevation angle of the reference microphone is changed to 1.5 radians in Example 4.

FIGS. 17A and 17B show the results obtained by using θ=1.5 rad included in the range proposed in the present embodiment, although equation (6) is not minimized. In this case, although the noise reduction amount at the far point (12, 12, 12) is 14.8 dB, which is much smaller than that in FIGS. 16A and 16B, this value is close to 15 dB, which is the general active noise reduction amount standard, and hence falls within an allowable range. The single adaptive notch filter scheme for reducing a signal frequency has been described so far.

(Multi-Channel SAN Scheme)

Figure 18:
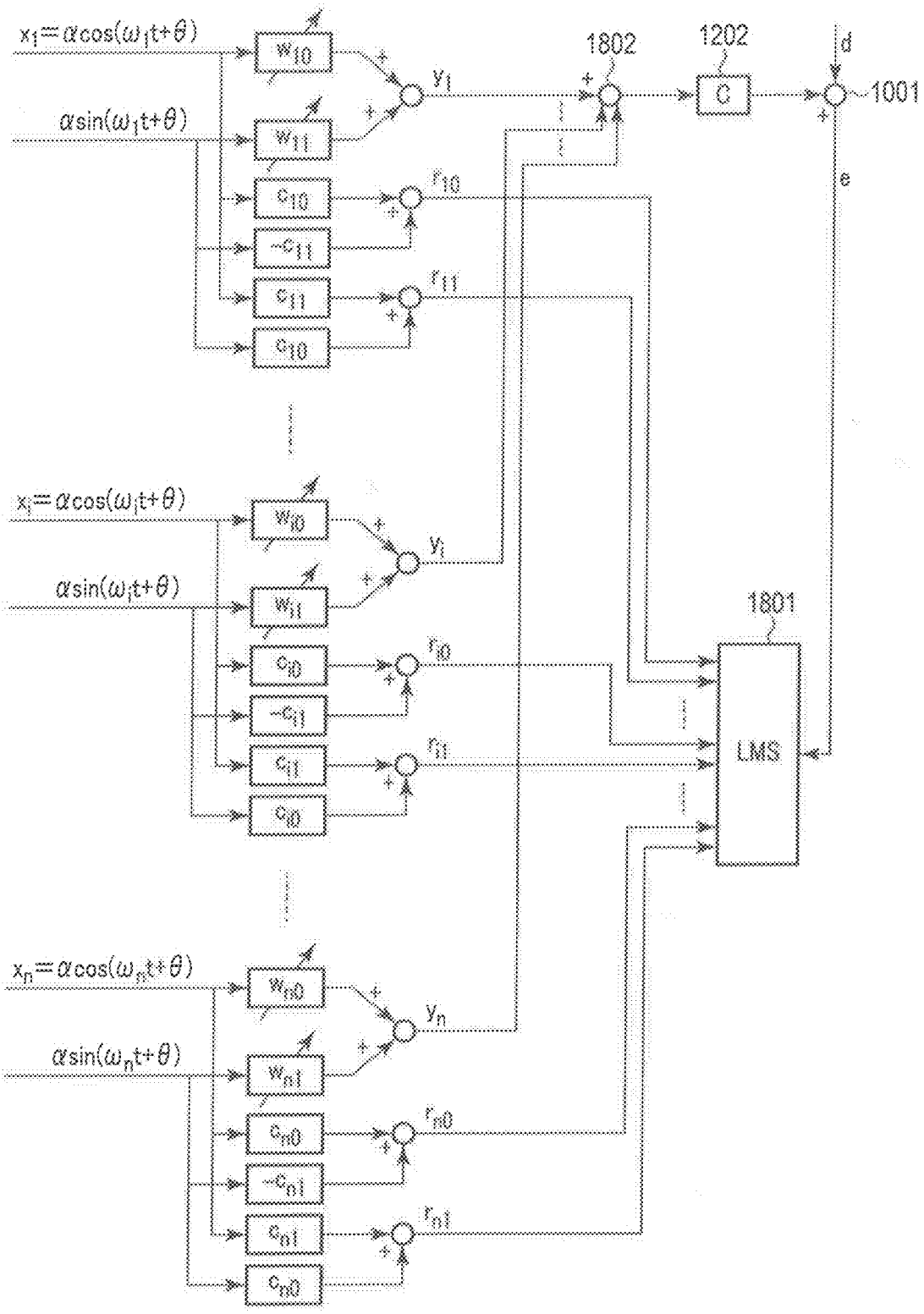
FIG. 18 is a block diagram showing still another example of the rotating blade noise reduction device according to the second embodiment.

A case using the multi-channel SAN scheme capable of reducing noise of double frequencies will be described below. As shown in FIG. 18, this rotating blade noise reduction device is provided with a plurality of units each including the filters 1211, 1212, 1221, 1222, 1231, and 1232 shown in FIG. 12.

Figure 13:
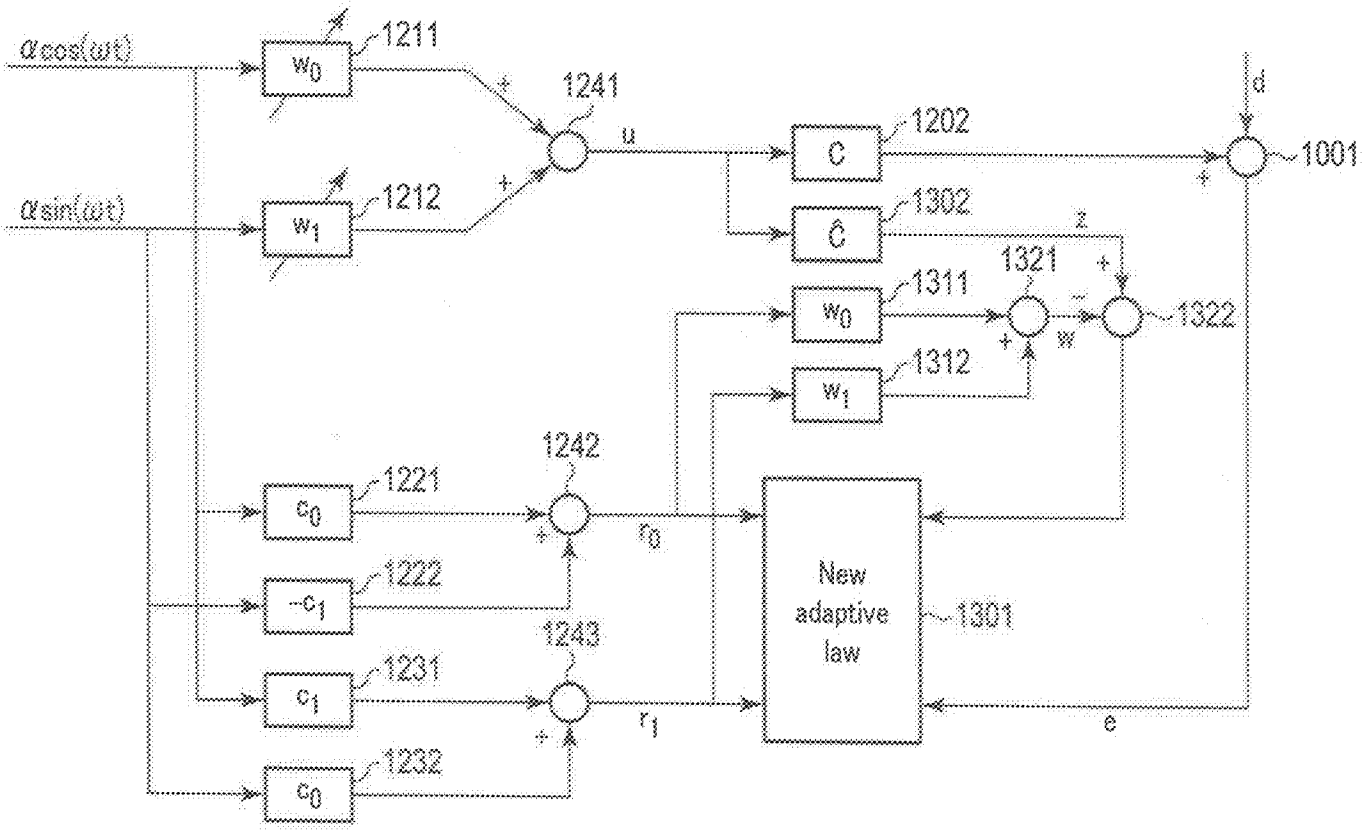
FIG. 13 is a block diagram showing another example of the rotating blade noise reduction device according to the second embodiment.

Sinusoidal signals of a plurality of frequencies ($\omega_1$=ΩB, $\omega_2$=2ΩB, . . . , $\omega_n$=nΩB (i=1, . . . , n)) are separately generated inside the device, and control constants $w_{i0}$ and $w_{i1}$ are prepared for each sinusoidal signal $x_i$ to perform adaptive updating. Constant vector updating formulae are based on the following equations ($r_{i0}$ and $r_{i1}$ respectively represent output signals from the adder shown in FIG. 18).

$$w_{i0}(t+1) = w_{i0}(t) - 2\mu e r_{i0} \Big/ \left(\sum_i (r_{i0}^2 + r_{i1}^2)\right) \tag{15}$$

$$w_{i1}(t+1) = w_{i1}(t) - 2\mu e r_{i1} \Big/ \left(\sum_i (r_{i0}^2 + r_{i1}^2)\right) \tag{16}$$

where $c_{0i}$ and $c_{1i}$ are respectively a real part and imaginary part of a secondary path characteristic corresponding to a target frequency $\omega_i$. When fast convergence is to be implemented while divergence is constrained as in the case of single frequency control, the arrangement shown in FIG. 13 is extended, and the following equations are used as constant vector updating formulae:

$$w_{i0}(t+1) = w_{i0}(t) - 2\mu(e(t) - (z(t) - w(t)))r_{i0}(t) \Big/ \left(\sum_i (r_{i0}^2 + r_{i1}^2)\right) \tag{17}$$

-continued $$w_{i1}(t+1) = w_{i1}(t) - 2\mu(e(t) - (z(t) - w(t)))r_{i1}(t) \Big/ \left(\sum_i (r_{i0}^2 + r_{i1}^2)\right) \tag{18}$$

$$z(y) = \sum_{i=1}^{CL-1} C_i y(t-i) \tag{19}$$

$$w(t) = \sum_{i=1}^{n} (w_{i0}(t)r_{i0}(t) + w_{i1}(t)r_{i1}(t)) \tag{20}$$

In addition, although the present embodiment has exemplified the ANC algorithm based on the single adaptive notch scheme, it is possible to use an &NC technique used for period noise reduction such as adaptive feedback ANC.

According to the second embodiment described above, it is possible to reduce noise from the rotating blades by generating a plurality of control signals so as to reduce sound pressures at the reference microphone, delaying the plurality of control signals by time delays corresponding to the respective loudspeakers dependent on installation angles between the loudspeakers arranged coaxially in a circumferential form from the circle center, the angular frequencies, and the loudspeaker count, and inputting the resultant control signals to the corresponding loudspeakers.

Figure 19:
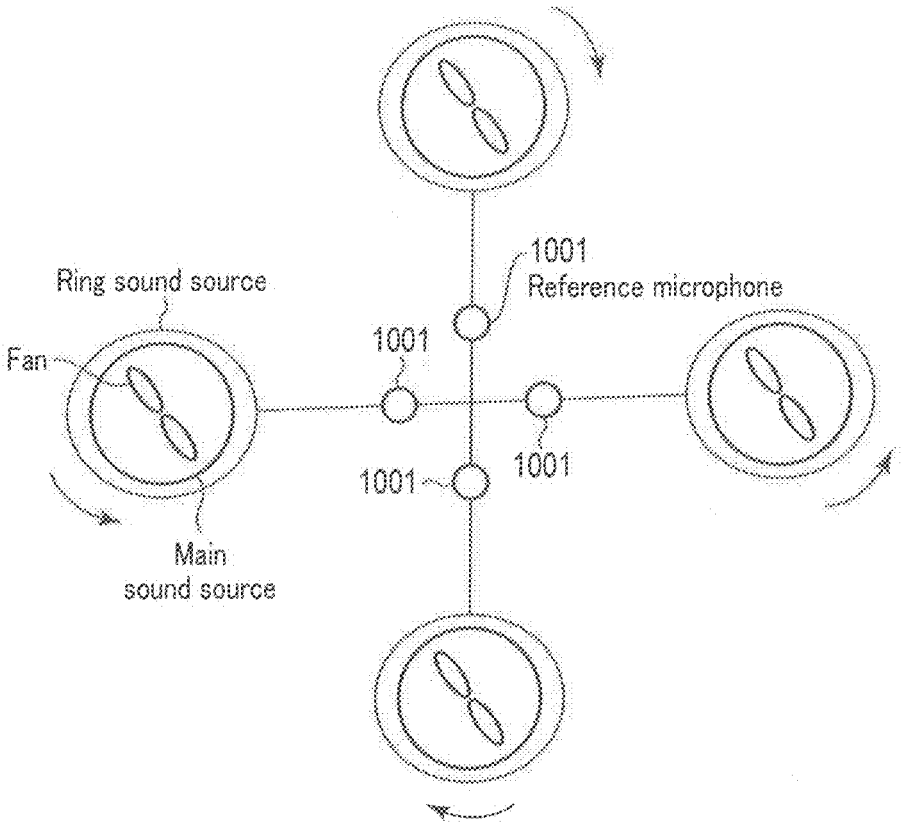
FIG. 19 is a view showing a form to which a rotating blade noise reduction device according to the third embodiment is applied.

A rotating blade noise reduction device based on consideration of noise interference caused by a plurality of rotors will be described below with reference to FIG. 19 and the subsequent drawings.

(Technique of Decoupling Noise from Rotors)

Because a flight vehicle generates similar angular frequencies during hovering flight, noise interference caused by the respective rotors makes it impossible for usual ANC techniques to achieve active noise reduction. The present embodiment proposes two techniques of solving airfoil flow noise generated by a flight vehicle having a plurality of rotors.

Third Embodiment (MIMO Type Crosstalk Cancellation ANC)

The first technique is a MIMO type active noise reduction system. This technique is designed to perform active noise reduction in consideration of the influence of crosstalk caused by the respective rotors. As in the above case, when the single adaptive notch technique is used, the arrangement obtained by extending the arrangement shown in FIG. 12 or 13 is used. Letting J (j=1, . . . , J) be a control ring count (rotor count), i (i=1, . . . , I) be a generator signal corresponding to a control ring j, and K (k=1, . . . , K) be a reference microphone count, control constant updating formulae are given as $$W_i^0(t+1) = W_i^0(t) - 2\mu C_i^0 R_i \tag{21}$$

$$W_i^1(t+1) = W_i^1(t) - 2\mu C_i^1 R_i \tag{22}$$

$$W_i^0 = [w_{1i}^0, w_{2i}^0, \ldots, w_{ji}^0]^T \tag{23}$$

$$W_i^1 = [w_{1i}^1, w_{2i}^1, \ldots, w_{ji}^1]^T \tag{24}$$

$$C_i^0 = \begin{bmatrix} c_{11}^{i0} & \ldots & c_{K1}^{i0} & -c_{11}^{i1} & \ldots & -c_{K1}^{i1} \\ \vdots & \ddots & \vdots & \vdots & \ddots & \vdots \\ c_{1j}^{i0} & \ldots & c_{Kj}^{i0} & -c_{1j}^{i1} & \ldots & -c_{Kj}^{i1} \end{bmatrix} \tag{25}$$

-continued $$C_i^1 = \begin{bmatrix} c_{11}^{i1} & \cdots & c_{K1}^{i1} & -c_{11}^{i0} & \cdots & c_{K1}^{i0} \\ \vdots & \ddots & \vdots & \vdots & \ddots & \vdots \\ c_{1j}^{i1} & \cdots & c_{Kj}^{i1} & -c_{1j}^{i0} & \cdots & c_{Kj}^{i0} \end{bmatrix} \quad (26)$$

$$R_i = [e_1 x_i, e_2 x_i, \ldots, e_K x_i, e_1 x_{2i}, e_2 x_{2i}, \ldots, e_K x_{2i}]^T \quad (27)$$

where I=J=K, $w_{ji}^0$ and $w_{ji}^1$ are respectively control constant gains from inputs $x_i=\cos(\omega_i t)$ and $x_{2i}=\sin(\omega_i t)$ to each single adaptive notch to each control ring sound source j, and $c^{i0}_{kj}$ and $c^{i1}_{kj}$ are a real part and imaginary part of a secondary path characteristic at a frequency corresponding to a driving angular frequency $\omega_i$ of $x_i$. Using the above MIMO scheme can effectively implement active noise reduction even at the time of hovering flight during which the respective rotors generate similar driving angular frequencies $\omega_1$ of $x_i$. In addition, when this technique copes with a plurality of orders, because equations (21) to (27) independently operate for target frequencies (for example, 90 Hz, 180 Hz, and 270 Hz), they may be executed in parallel.

The rotating blade noise reduction device according to the present embodiment updates the respective control filters, which generate the respective control signals by the active noise reduction algorithm considering interference, by using control signals corresponding to the angular frequencies of the respective rotating blades, microphone signals from the respective reference microphones, and spatial transfer characteristics from the plurality of loudspeakers arranged in a circumferential form to the respective reference microphones so as to reduce sound pressures at the reference microphones respectively arranged near the rotating blades.

Example 5

The following exemplifies the results obtained by performing active noise reduction during the hovering flight of a flight vehicle having six rotors by using the control technique according to the present embodiment.

Assume that the respective rotors are rotating at the same angular frequency because the flight vehicle is hovering. Simulation conditions are set as follows. Note that the following position of each reference microphone represents a polar coordinate indication with the center of each rotor being the origin, the x-axis extends from the center of the rotor to the center of the flight vehicle, and the s-axis extends above the flight vehicle (that is, vertically above). In this example, six reference microphones are set, and their positions are represented by polar coordinate indications in correspondence with the respective rotors as follows.

the ring-like main sound source count: 36 (the main sound sources are also counted as discrete ring sound sources for the sake of convenience)

a main sound source ring radius a: 0.38 m the ring-like control sound source count: 10 a control sound source ring radius b: 0.45 m the reference microphone position; (r, θ, ϕ)=(0.7, 1.3, 0)

the blade count: B=2 the order under consideration: x=1 the angular frequency: Ω=45×2×π the distance from the flight vehicle center to each rotor center; 0.95 m

Figure 20A:
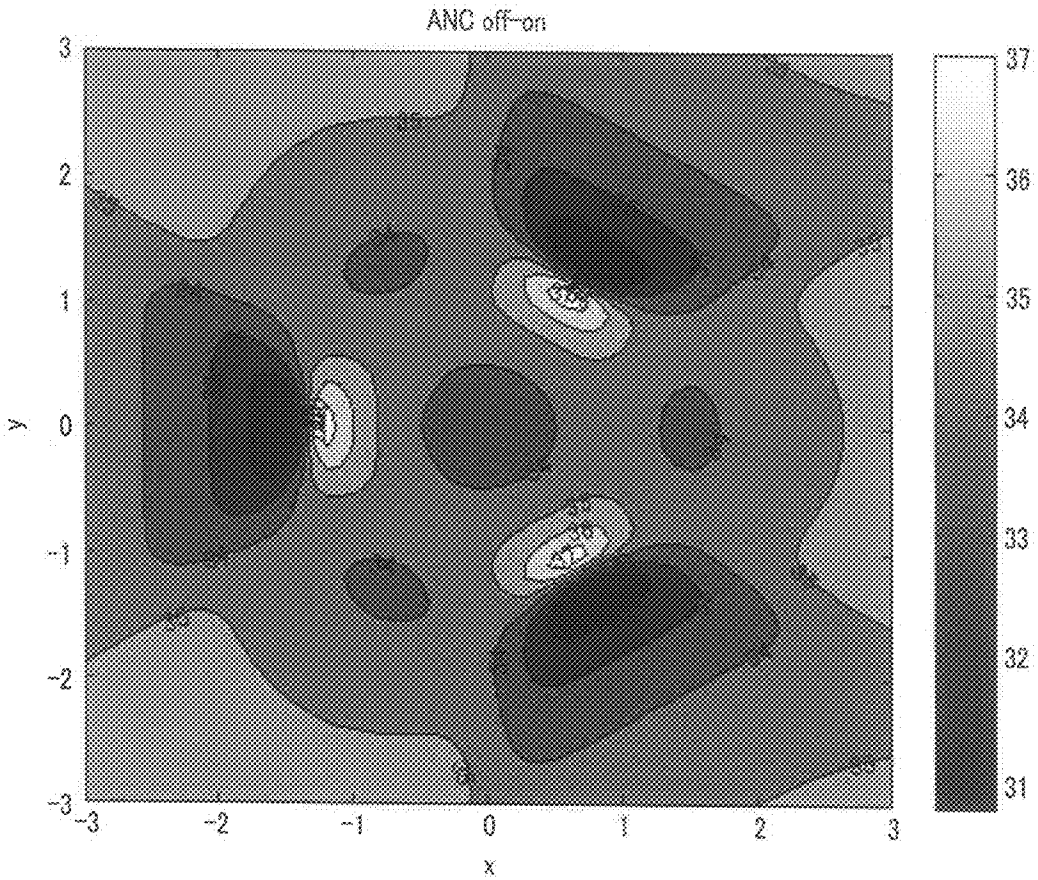
FIG. 20A is a graph showing the distribution of active noise reduction amount sound pressures 3 meters above the plane on which a main sound source and a control sound source ring are arranged in Example 5.
Figure 20B:
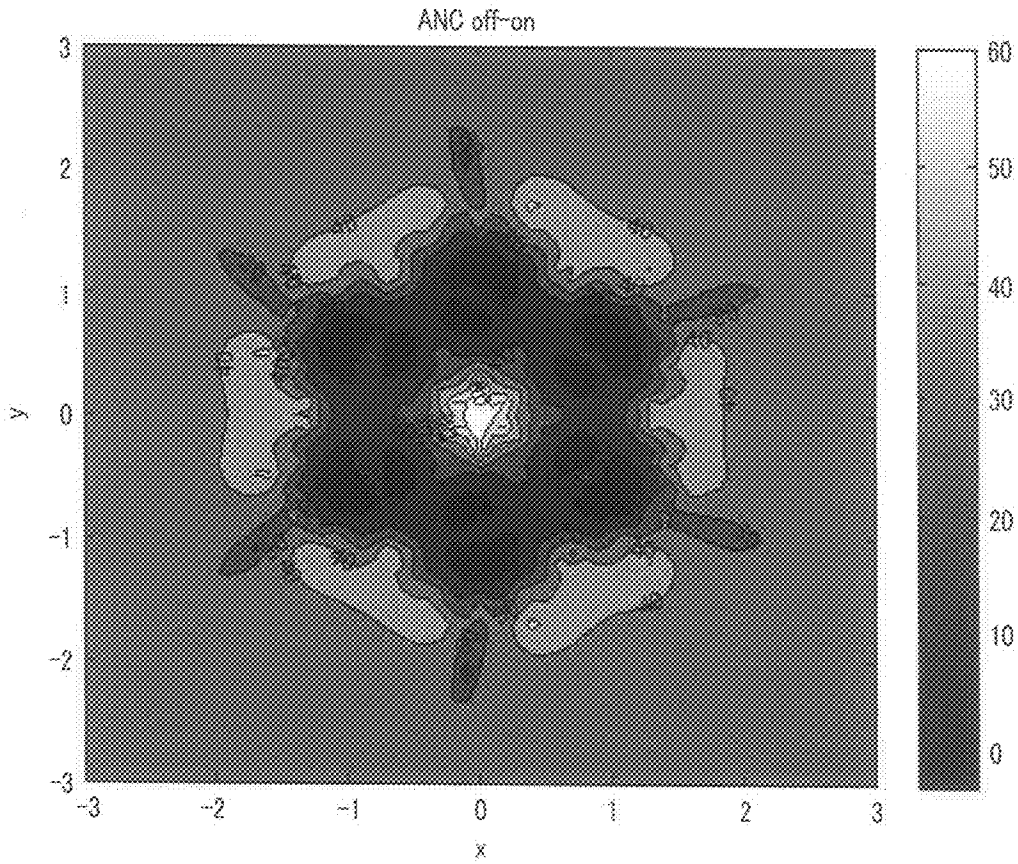
FIG. 20B is a graph showing the distribution of active noise reduction amount sound pressures on an x-y plane including the installation position of a reference microphone in Example 5.

FIGS. 20A and 20B show active noise reduction control results. The noise reduction amount at a far point (12, 12, 12) (=(x, y, z)) is 36.1 dB. It is therefore obvious that noise is sufficiently reduced.

According to the third embodiment, it is possible to effectively reduce rotating blade noise in consideration of the influence of crosstalk, caused by the respective rotating blades (rotors), by updating the respective control filters, which generate control signals for the respective loudspeakers by the active noise reduction algorithm considering interference, by using control signals corresponding to the angular frequencies of the respective rotating blades, microphone signals from the respective reference microphones, and spatial transfer characteristics from the plurality of loudspeakers arranged in a circumferential form to the respective reference microphones so as to reduce sound pressures at the reference microphones respectively arranged near the rotating blades.

Fourth Embodiment (Acquisition Area Limitation by Ring Array Microphone)

Figure 21:
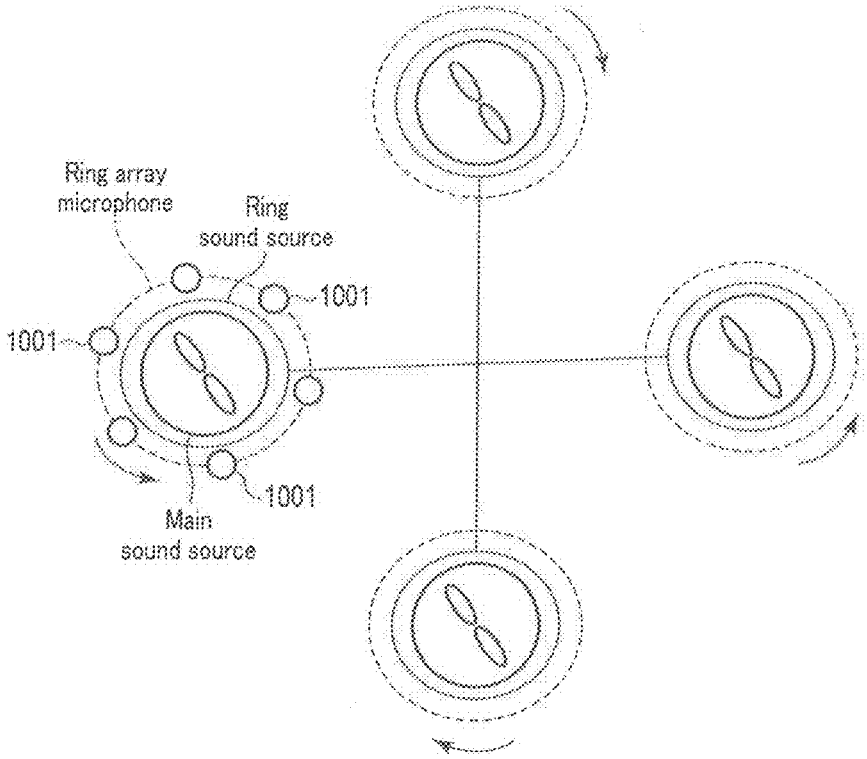
FIG. 21 is a view showing a form to which a rotating blade noise reduction device according to the fourth embodiment is applied.

The present embodiment will exemplify a technique of constraining interference by using a plurality of reference microphones for each rotor. As shown in FIG. 21, according to the present embodiment, a plurality of reference microphones (also called ring reference microphones) are arranged on a circumference of each rotor to form a ring array microphone which delays signals output from the respective reference microphones in accordance with fan angular frequencies and the count of reference microphones arranged for each rotor, thereby acquiring only noise around a specific rotor. This makes it possible to implement airfoil flow noise reduction independently for each rotor.

Figure 22:
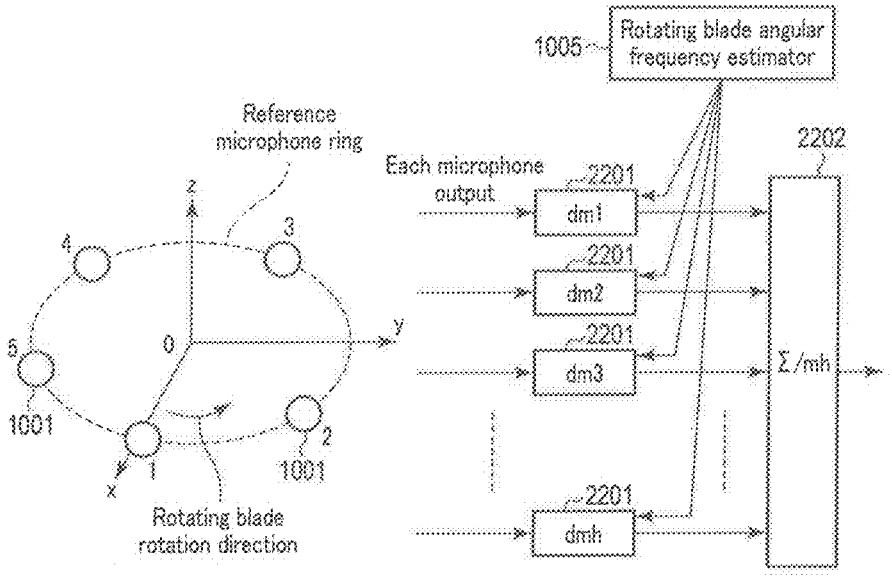
FIG. 22 is a view showing a plurality of reference microphones in the form shown in FIG. 21 and a device portion which combines output signals from the microphones.

FIG. 22 shows a concrete arrangement example of that portion of the rotating blade noise reduction device according to the present embodiment which combines output signals from a plurality of reference microphones for each rotor. A delay time in each microphone signal is represented by the following equation, which is set for compensating for the delay given by equation (10).

$$dm_i = -2\pi i/(mh\Omega) \quad (28)$$

Although the technique according to the present embodiment leads to an increase in a reference microphone count mh, the processing system is simple, and hence the calculation load is light. In addition, the active noise reduction system does not require any complicated computation like that in the third embodiment, and can perform active noise reduction for each rotor with the simple processing shown in FIGS. 12 and 13. In this case, although the larger the microphone count, the better, the count of control loudspeakers used for each rotor is set to 2M+1 or more in consideration of cost. In addition, the installation positions of these loudspeakers are determined based on the premise that a main sound source ring radius a or more is set and each zenith angle is determined based on the first embodiment.

Example 6

Figure 23:
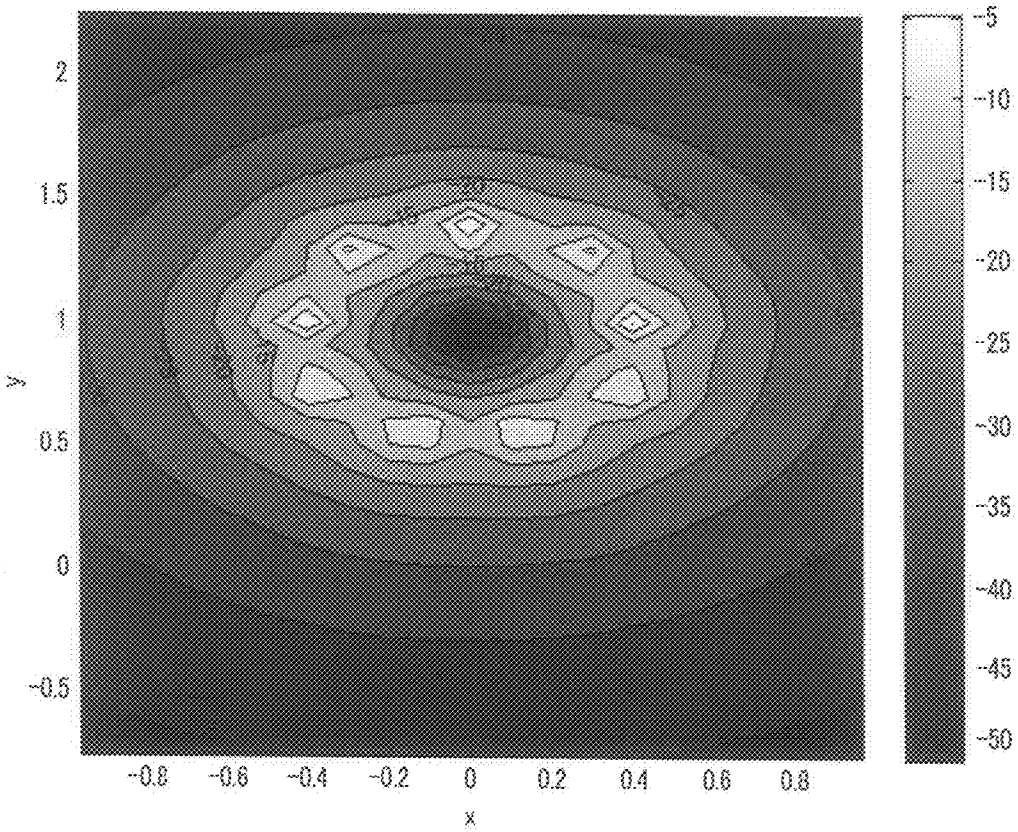
FIG. 23 is a graph showing the distribution of active noise reduction amount sound pressures on an x-y plane including the installation positions of reference microphones arranged on each rotor in FIG. 21.

FIG. 23 shows the result obtained by simulating an acquired sound pressure distribution at a microphone ring under the following simulation conditions.

Figure 24:
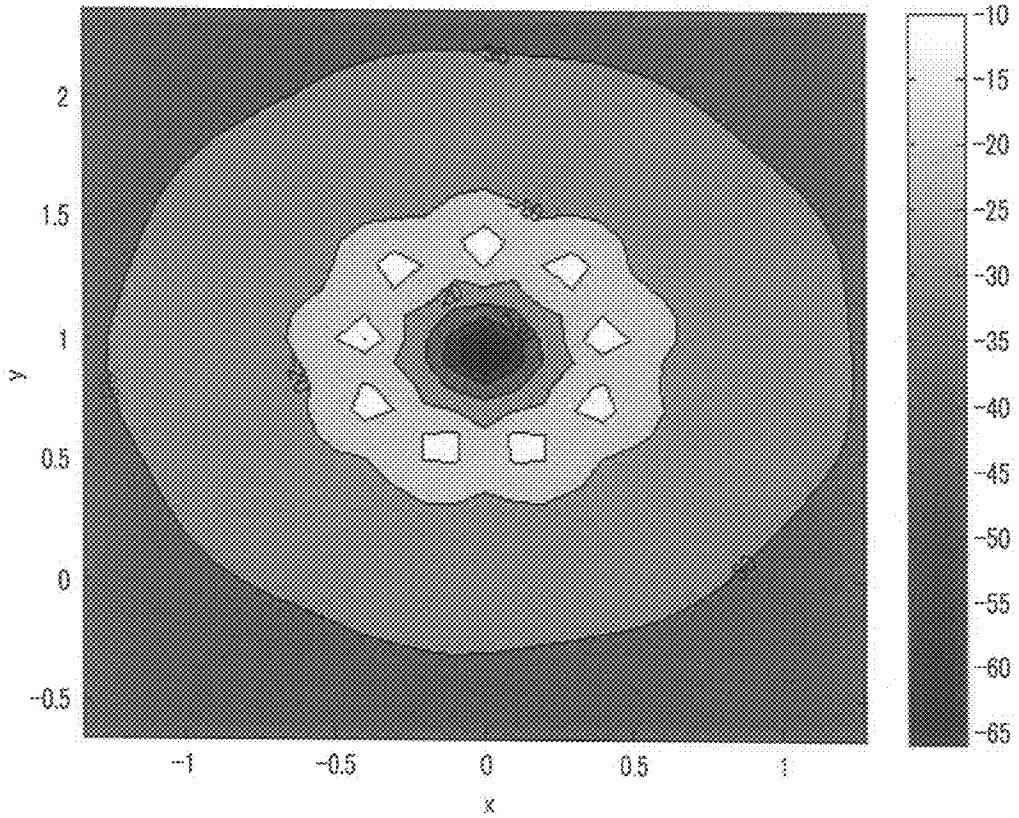
FIG. 24 is a graph showing the distribution of active noise reduction amount sound pressures when the order in FIG. 23 is changed to 3.

FIG. 23 shows the acquired sound pressure distribution at the microphone ring arranged around one rotor (coordinate center (0, 0.95, 0)). This distribution, represents the easiness of acquisition of a sound wave generated from each position. Each value is determined with the sound pressure at a maximum value acquisition point being 0 dB. That is, noise generated from the range indicated in bright colors in FIG. 23 can be easily acquired.

the ring-like main sound source count: 36 (the main sound sources are also counted as discrete ring sound sources for the sake of convenience)

the main sound source ring radius ä: 0.38 m the reference microphone ring radius: 0.42 m a reference microphone count mh : 9 the reference microphone position (polar coordinates with coordinates (0, 0.95, 0) being the origin): $(r, \theta, \phi)=(0.42, \pi/2, 2\pi i/9)$ $(i=0, \ldots, 8)$ the blade count: B=2 the order under consideration: x=1 the angular frequency: $\Omega=45\times2\times\pi$ the distance from the flight vehicle center to each rotor: 0.95 m This result indicates that noise on the microphone ring circumference can be emphasized and acquired by arranging a sufficient count of microphones on each rotor circumference and properly applying delay processing. FIG. 24 shows the result with order x=3. Like the distribution shown in FIG. 23, the sound pressure distribution near the outer circumference of the array microphone does not have a circular shape but has a shape dependent on a microphone count.

Figure 25:
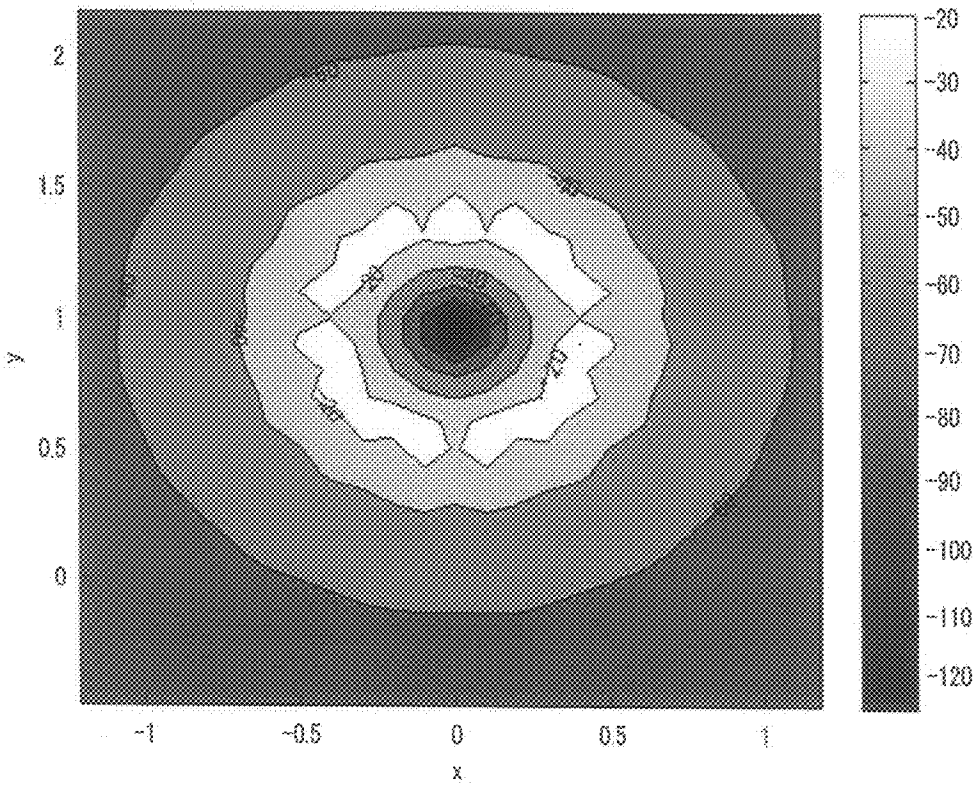
FIG. 25 is a graph showing the distribution of active noise reduction amount sound pressures when the reference microphone count in FIG. 24 is increased to 15.

This problem can be solved by increasing the microphone count. For example, using 15 microphones can obtain a circular sound pressure distribution like that shown in FIG. 25, thus solving the problem. According to the above description, this proposal uses 2M+1 or more reference microphones.

According to the fourth embodiment described above, the active noise reduction processor can reduce noise independently for each rotating blade (rotor) with respect to a plurality of ring reference microphones including a ring array microphone, arranged for each rotating blade of a flight vehicle, by using, as an error signal, the signal obtained by delaying output signals from the respective ring reference microphones by time delays dependent on the installation angles between the ring reference microphones arranged on a circumference from the circle center, the angular frequencies, and the ring reference microphone count, and averaging the resultant signals.

In addition, the respective devices described above and their device portions each can be implemented by either a hardware arrangement or a composite arrangement of hardware resources and software. As software of each composite arrangement, a program is used, which is installed in advance from a network or computer-readable recording medium into a computer, and is executed by the processor of the computer to cause the computer to implement the function of each device. In addition, the embodiments incorporate attaching a duct with a proper height to the outer circumference of a fan to reduce a control effect deterioration caused by the wind generated by rotating blades.

It is possible to execute instructions indicated by the processing procedures presented in the above embodiments on the basis of programs as software. It is also possible to obtain the same effects as those obtained by the above rotating blade noise reduction device by causing a general-purpose computer system to store the programs in advance and read them. The instructions described in the above embodiments are stored, as programs which can cause a computer to execute them, in a recording medium such as a magnetic disk (a flexible disk, hard disk, or the like), an optical disk (a CD-ROM, CD-R, CD-RW, DVD-ROM, DVD±R, DVD±RW, Blu-ray® Disc, or the like), a semiconductor memory, or a similar recording medium. The recording medium to be used may take any storage forms as long as it can be read by a computer or a built-in system. The computer can implement the same operation as that of the rotating blade noise reduction device of each embodiment described above by causing the CPU to read a program from this recording medium and execute it. Obviously, the computer may acquire or read the programs through a network.

In addition, an OS (Operating System) operating on a computer on the basis of instructions from programs installed from a recording medium into the computer or a built-in system, MW (middleware) such as database management software or network software, or the like may execute part of the processes for implementing this embodiment.

The recording medium in the present embodiment includes not only a medium independent of the computer or the built-in system but also a recording medium in which a program sent through a LAN, Internet, or the like is downloaded and stored or temporarily stored.

In addition, the number of recording media is not limited to one, and the recording medium of the present embodiment also includes a plurality of media used to execute the processes in the present embodiment. That is, any medium arrangement can be used.

Note that the computer or the built-in system in the present embodiment is designed to execute the respective processes in the embodiment on the basis of the programs stored in the recording medium, and may take any arrangement, e.g., an apparatus comprising a single device such as a personal computer or microcomputer or a system having a plurality of devices connected to each other through a network.

Furthermore, the computer of the present embodiment is not limited to a personal computer, and is a generic name for devices and apparatuses capable of implementing the functions of the present embodiment on the basis of programs, including arithmetic processing units, microcomputers, and the like contained in information processing devices.

While certain embodiments have been described, these embodiments have been presented by way of example only, and are not intended, to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotating blade noise reduction device for reducing noise from a flight vehicle including a plurality of rotating blades, the device comprising:

a plurality of loudspeakers arranged coaxially in a circumferential form for each of the rotating blades;

one or more reference microphones configured to acquire noise generated from the rotating blades and a plurality of control sounds generated from the loudspeakers;

an angular frequency estimator configured to estimate angular frequencies of the rotating blades; and an active noise reduction processor configured to generate a plurality of control signals so as to reduce sound pressures at the reference microphones, configured to delay the control signals by time delays dependent on installation angles, the angular frequencies estimated, and a number of the loudspeakers, and configured to input the control signals to the loudspeakers, the time delays corresponding to the loudspeakers, the installation angles being between the loudspeakers arranged coaxially in a circumferential form from a circle center.

2. The device according to claim 1, wherein the active noise reduction processor updates control filters for generating control signals using an active noise reduction algorithm considering interference by using control signals corresponding to angular frequencies of rotating blades, microphone signals from the reference microphones, and spatial transfer characteristics from the loudspeakers arranged in a circumferential form to the reference microphones so as to reduce sound pressures at the reference microphones arranged near the rotating blades.

3. A rotating blade noise reduction device for reducing noise from a flight vehicle including a plurality of rotating blades, the device comprising:

a plurality of loudspeakers arranged coaxially in a circumferential form for each of the rotating blades;

one or more reference microphones configured to acquire noise generated from the rotating blades and a plurality of control sounds generated from the loudspeakers;

an angular frequency estimator configured to estimate angular frequencies of the rotating blades; and an active noise reduction processor configured to generate a plurality of control signals so as to reduce sound pressures at the reference microphones, configured to delay the control signals by time delays corresponding to the loudspeakers dependent on installation angles between the loudspeakers arranged coaxially in a circumferential form from a circle center, the angular frequencies estimated, and a number of the loudspeakers, and configured to input the control signals to the loudspeakers, wherein the active noise reduction processor uses, as an error signal for a plurality of ring reference microphones including a ring array microphone arranged for rotating blades of the flight vehicle, a signal obtained by delaying output signals from the ring reference microphones by time delays dependent on installation angles between the ring reference microphones arranged on a circumference from the circle center, the angular frequencies, and a number of the ring reference microphones, and averaging the signals.

4. The device according to claim 3, wherein when a rotating blade radius is represented by a, the loudspeakers are arranged on a circumference with a radius b which is as close to a as possible and is at least not more than 2a.

5. The device according to claim 3, wherein when the acquired noise is reduced up to a control target order x with respect to a rotating blade of a blade count B, the not less than 2Bx+1 loudspeakers are arranged for the rotating blade.

6. The device according to claim 3, wherein when 2Bx+1 to 2Bx+2 loudspeakers are arranged in a circular form for each rotating blade, a reference microphone is arranged at a distance from a center of the each rotating blade which is not less than a radius b of a circle on which the loudspeakers are arranged in a circular form and at a zenith angle of not less than 0.3 rad and not more than 0.7 rad.

7. The device according to claim 3, wherein when 2Bx+3 or more loudspeakers are arranged in a circular form for each rotating blade, r is set to be not less than a radius b of a circle on which the loudspeakers are arranged in a circular form, a reference microphone is arranged at (r, θ, ϕ) where ϕ is an arbitrary number, letting a be a rotating blade radius, $h_m$ be an m-order second class spherical Hankel function, rp be a rotation ring radius, L be the number of the loudspeakers, and $P^m_n$ be an associated Legendre function, then $$r_i = \|(r\sin(\theta)\cos(\phi),\ r\sin(\theta)\sin(\phi),\ r\cos(\theta)) - rp \times (\cos\phi_i,\ \sin\phi_i,\ 0)\| \tag{4}$$

$$T(r, rp, \theta) = \left\{ \sum_{i=1}^{L} h_M(kr_i) P_M^M(\cos(\theta)) \right\} \tag{5}$$

$$J(r, \theta_0) = \sum_{\theta} \{\|T(r, a, \theta) - k_b(\theta_0) \times T(r, b, \theta)\|\} \tag{6}$$

$$\|T(r, a, \theta_0)\| - k_b(\theta_0) \times \|T(r, b, \theta_0)\| \tag{7}$$

and the reference microphone is arranged at a zenith angle θ that minimizes equation (6).

8. The device according to claim 3, wherein when 2Bx+3 or more loudspeakers are arranged in a circular form for each rotating blade, the reference microphone is arranged at a distance from a center of the rotating blade which is not less than a radius b of a circle on which the loudspeakers are arranged in a circular form, and on the same plane as the rotating blade and the loudspeaker.

9. The device according to claim 3, wherein when 2Bx+3 or more loudspeakers are arranged in a circular form for each rotating blade, the reference microphone is arranged at a distance from a center of the rotating blade which is not less than a radius b of a circle on which the loudspeakers are arranged in a circular form and at a zenith angle of not less than 1.1 rad and not more than 2.1 rad.

10. The device according to claim 3, wherein the active noise reduction processor includes a filter for correcting an individual difference between loudspeakers in addition to the time delay.

11. The device according to claim 3, wherein the angular frequency estimator estimates an angular frequency from a command value to a rotating device for driving the rotating blade or estimates an angular frequency from generated noise or a generated wind velocity.

12. The device according to claim 3, wherein the active noise reduction processor updates a control filter for generating a control signal using an active noise reduction algorithm by using the control signals, microphone signals from the reference microphones, and spatial transfer characteristics from the loudspeakers arranged in a circumferential form to the reference microphones so as to reduce a sound pressure at the reference microphone.

13. The device according to claim 3, wherein when the acquired noise is reduced up to a control target order x with respect to rotating blades of a blade count B, not less than 2Bx+1 reference microphones are arranged for the rotating blade.

14. A flight vehicle comprising the rotating blade noise reduction device defined in claim 3.

15. A non-transitory computer readable medium storing a computer program which is executed by a computer to provide the steps of:

acquiring, at one or more reference microphones, noise generated from a plurality of rotating blades and a plurality of control sounds generated from loudspeakers, the loudspeakers being arranged coaxially in a circumferential form for each of the rotating blades;

estimating angular frequencies of the rotating blades;

generating a plurality of control signals so as to reduce sound pressures at the reference microphones;

delaying the control signals by time delays dependent on installation angles, the angular frequencies estimated, and a number of the loudspeakers, the time delays corresponding to the loudspeakers, the installation angles being between the loudspeakers arranged coaxially in a circumferential form from a circle center; and inputting the control signals to the loudspeakers.

* * * * *